US007955235B2

(12) United States Patent
Keiser

(10) Patent No.: US 7,955,235 B2
(45) **Date of Patent: *Jun. 7, 2011**

(54) EXERCISE APPARATUS

(75) Inventor: Dennis L. Keiser, Sanger, CA (US)

(73) Assignee: Keiser Corporation, Fresno, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/697,103

(22) Filed: Jan. 29, 2010

(65) Prior Publication Data

US 2010/0137114 A1 Jun. 3, 2010

Related U.S. Application Data

(60) Continuation of application No. 11/669,030, filed on Jan. 30, 2007, now Pat. No. 7,686,749, which is a division of application No. 10/294,476, filed on Nov. 13, 2002, now Pat. No. 7,172,538.

(60) Provisional application No. 60/332,468, filed on Nov. 13, 2001.

(51) Int. Cl.
*A63B 21/008* (2006.01)

(52) U.S. Cl. ..... 482/112

(58) Field of Classification Search ..... 482/111–112, 482/139, 148, 92–96, 97–100, 51, 62
See application file for complete search history.

(56) References Cited

U.S. PATENT DOCUMENTS

| | | | | |
|---|---|---|---|---|
| 325,404 | A * | 9/1885 | Forest | 482/102 |
| 1,015,071 | A | 1/1912 | Reach | |
| 2,932,509 | A | 4/1960 | Zinkin | |
| 3,074,716 | A | 1/1963 | Mitchel et al. | |
| 3,385,590 | A * | 5/1968 | Avner | 267/64.24 |
| 3,387,843 | A | 6/1968 | Chandler | |
| 3,451,271 | A | 6/1969 | Knoblauch | |
| 3,515,248 | A * | 6/1970 | Kyllonen | 188/202 |
| 3,692,296 | A | 9/1972 | Higginbotham | |
| 3,784,194 | A | 1/1974 | Perrine | |
| 3,822,599 | A | 7/1974 | Brentham | |
| 4,050,310 | A | 9/1977 | Keiser | |
| 4,227,689 | A | 10/1980 | Keiser | |
| 4,247,098 | A | 1/1981 | Brentham | |
| 4,256,302 | A | 3/1981 | Keiser et al. | |

(Continued)

FOREIGN PATENT DOCUMENTS

FR 2581550 A1 11/1986

(Continued)

OTHER PUBLICATIONS

PCT International Search Report, Jan. 12, 2004.

*Primary Examiner* — Lori Baker

(74) *Attorney, Agent, or Firm* — Knobbe Martens Olson & Bear LLP

(57) ABSTRACT

An exercise apparatus includes a compact resistance unit that houses a pneumatic cylinder. The cylinder is connected to a pulley wheel that moves at least toward the cylinder. A main cable extends about a portion of the pulley wheel. One end of the main cable is fixed to the unit housing and the other end is attached to a pulley block of a block-and-tackle mechanism. A user cable extends through the block-and-tackle mechanism and is connected to a handle. The pneumatic cylinder resists movement of the handle away from the unit.

21 Claims, 15 Drawing Sheets

U.S. PATENT DOCUMENTS

| | | | | | |
|---|---|---|---|---|---|
| 4,257,593 | A | | 3/1981 | Keiser | |
| 4,326,707 | A | | 4/1982 | Strecker | |
| 4,500,089 | A | | 2/1985 | Jones | |
| 4,549,733 | A | * | 10/1985 | Salyer | 482/103 |
| 4,609,190 | A | | 9/1986 | Brentham | |
| 4,700,946 | A | | 10/1987 | Breunig | |
| 4,720,099 | A | | 1/1988 | Carlson | |
| 4,722,525 | A | | 2/1988 | Brentham | |
| 4,730,829 | A | | 3/1988 | Carlson | |
| 4,911,436 | A | * | 3/1990 | Lighter | 482/113 |
| 4,915,379 | A | | 4/1990 | Sapp | |
| 4,976,426 | A | | 12/1990 | Szabo et al. | |
| 5,018,725 | A | * | 5/1991 | Cook | 482/103 |
| 5,044,632 | A | | 9/1991 | Jones | |
| 5,060,939 | A | | 10/1991 | Oswald et al. | |
| 5,102,122 | A | * | 4/1992 | Piane et al. | 482/133 |
| 5,114,389 | A | | 5/1992 | Brentham | |
| 5,145,479 | A | | 9/1992 | Olschansky et al. | |
| 5,158,516 | A | | 10/1992 | Johnson | |
| 5,310,394 | A | | 5/1994 | Kallios | |
| 5,312,315 | A | | 5/1994 | Mortensen et al. | |
| 5,336,145 | A | | 8/1994 | Keiser | |
| 5,403,257 | A | * | 4/1995 | Lehtonen | 482/112 |
| 5,526,692 | A | | 6/1996 | Keiser | |
| 5,558,607 | A | * | 9/1996 | Darling | 482/95 |
| 5,776,040 | A | * | 7/1998 | Webb et al. | 482/98 |
| 5,890,996 | A | | 4/1999 | Frame et al. | |
| 6,142,919 | A | * | 11/2000 | Jorgensen | 482/121 |
| 6,375,598 | B1 | | 4/2002 | Frame et al. | |
| 6,447,430 | B1 | * | 9/2002 | Webb et al. | 482/98 |
| 7,094,185 | B2 | * | 8/2006 | Greenland | 482/100 |
| 7,172,538 | B2 | * | 2/2007 | Keiser | 482/140 |
| 7,608,024 | B2 | * | 10/2009 | Sechrest et al. | 482/94 |
| 7,625,321 | B2 | * | 12/2009 | Simonson et al. | 482/103 |
| 7,686,749 | B2 | * | 3/2010 | Keiser | 482/112 |
| 2002/0025890 | A1 | | 2/2002 | Keiser | |
| 2006/0189462 | A1 | * | 8/2006 | Pearson et al. | 482/142 |
| 2007/0161470 | A1 | * | 7/2007 | Berryman | 482/94 |
| 2010/0137114 | A1 | * | 6/2010 | Keiser | |

FOREIGN PATENT DOCUMENTS

| | | |
|---|---|---|
| FR | 2645032 | 10/1990 |
| GB | 2240727 | 8/1991 |

* cited by examiner

EXERCISE APPARATUS

RELATED APPLICATIONS

This application is a continuation of application Ser. No. 11/669,030, filed on Jan. 30, 2007, which is a divisional of U.S. patent application Ser. No. 10/294,476, filed Nov. 13, 2002, now issued as U.S. Pat. No. 7,172,538 on Feb. 6, 2007, which claims priority under 35 U.S.C. §119(e) to U.S. Provisional Patent Application Ser. No. 60/332,468, filed Nov. 13, 2001, all of which are hereby expressly incorporated by reference in their entireties.

BACKGROUND OF THE INVENTION

1. Field of the Invention

The present invention relates to an exercise apparatus and, more particularly, to an adjustable exercise apparatus that can be used for a multitude of exercises.

2. Description of Related Art

Many exercise devices have been developed of a "weight type" in which weights provide resistance to the exertion of muscular force. Such machines commonly employ weight stacks that allow a user to vary the weight lifted during the exercise. U.S. Pat. Nos. 6,447,430, 5,776,040, and 4,500,089 are examples of such machines.

Weight stack machines often, in normal use, do not provide a consistent resistance. A weight lifter normally thinks that 100 pounds of weight will provide 100 pounds of resistance throughout the exercise stroke; however, this is true only if the weight is moved at a slow and generally constant speed. If the weight lifter quickly moves the weight, the changes in speed of movement will cause the weight to change. Accordingly, manufacturers of weight stack machines commonly instruct those training on their machines to train at a speed of out on two seconds and back on four seconds, thus keeping the speed slow enough to make the acceleration forces insignificant. However, if a user accelerates the weight during the exercise stroke, the resistance force will change.

Pneumatic exercise equipment has been developed in response to this shortcoming of weight stacks. Such exercise equipment simulates the desired characteristics of a weight stack exercise machine by easily permitting the weight lifter to increase or decrease the resistance; however, pneumatic exercise equipment also permits the weight lifter to increase speed without the resistance changing because such machines do not have a significant inertia of motion. Consequently, pneumatic exercise equipment ensures full muscular effort throughout the stroke.

Pneumatic exercise equipment commonly include a pneumatic cylinder with a piston rod that moves linearly. A piston divides the cylinder into two chambers. The rod is connected to the piston and extends through one of the chambers. The piston rod also is usually operatively connected to a handle or other user interface. As the user pushes (or pulls, depending upon which cylinder chamber is pressurized) on the handle, movement of the rod is resisted by air within the cylinder. This resistance to further movement provides exercise resistance.

Over the stroke of the rod within the cylinder, it can be expected that the resistance provided by the cylinder will increase as the rod is progressively pushed into the cylinder. To make this increase less dramatic, an air reservoir, also known as an accumulator, can be coupled with the cylinder through an air line. The air line allows air to flow between the cylinder and the accumulator and thus equalizes the air pressure between these components.

The user can choose a preset resistance force by controlling the air pressure within the cylinder/accumulator assembly. A source of compressed air communicates with the accumulator through an air supply line. An air addition valve, a pressure gauge, and a bleed-off valve are interposed in the line. The pressure gauge preferably is configured to display the resistance force anticipated for the user rather than the actual air pressure within the system. To adjust the resistance force to a desired level, the user adds or removes air from the pneumatic system. Air is added by actuating the air addition valve. Air is removed by actuating the bleed-off valve. U.S. Pat. No. 4,257,593 discloses an example of a pneumatic exercise device.

Due to the nature of pneumatics, the resistance curve produced for a given air pressure as the piston rod is moves from an initial position to a fully retracted position (or fully extended position if pulled) remains substantially the same even though the speed at which the piston rod moves may vary. The resistance, however, will increase during the exercise stroke as the air compresses under the exerted force of the user.

SUMMARY OF THE INVENTION

The present exercise apparatus offers a range of adjustability and resistances so that a single piece of exercise equipment can be used to perform a multitude of different exercises. Another aspect of the exercise apparatus involves providing a pneumatic exercise apparatus that produces generally constant resistance throughout the entire exercise stroke. An additional aspect involves a compact pneumatic exercise apparatus that can be mounted to or supported by the floor, wall or other support structure.

In accordance with one aspect of the invention, an exercise apparatus is provided comprising a frame and a user interface (e.g., a handle) that is movable between a retracted position and an extended position. A pneumatic actuator is disposed on the frame and includes a cylinder and a piston rod. The piston rod extends from the cylinder along a stroke axis. A pulley wheel is rotatably connected to the piston rod and a cable is wrapped about at least a portion of the pulley wheel. The cable has a first cable end and a second cable end. The first cable end is fixed to the frame and the second cable end is coupled to the user interface.

Another aspect of the invention involves an exercise system comprising a station frame and a resistance unit being configured to provide an exercise resistance force. The resistance unit cooperates with a user interface and is movably connected to the station frame. In this manner, the resistance unit can be moved between at least a first position and a second position on the frame.

In a preferred mode, the exercise system comprises at least two resistance units. At least one of the units is movably connected to the frame, and preferably, both are movably connected to the frame.

In accordance with an additional aspect of the present invention, an exercise apparatus is provided that comprises a pneumatic cylinder, a first air reservoir and at least a second air reservoir. The pneumatic cylinder and the reservoirs are connected by at least one air equalization line so as to maintain generally equal air pressures within the cylinder and the reservoirs. The second reservoir selectively communicates with the first reservoir and the cylinder.

An additional aspect of the present invention involves a seat assembly that is movably connected to a frame of an exercise apparatus. In this manner the seat assembly can be moved between at least a first position and a second position. The seat assembly preferably includes a bottom that is connected to a support post. The support post has at least one wheel. The seat assembly can be connected to a guidepost of the frame, and preferably, the seat assembly can slide relative to the guidepost and be selectively fixed relative to the guidepost to vary its position and orientation.

For purposes of summarizing the invention and the advantages achieved over the prior art, certain aspects and advantages of the invention have been described herein above. Of course, it is to be understood that not necessarily all such aspects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other aspects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

The foregoing and other features, aspects and advantages of the present invention will now be described with reference to the drawings of preferred embodiments, which are intended to illustrate and not to limit the present invention. The drawings comprise 13 figures.

DETAILED DESCRIPTION OF PREFERRED EMBODIMENTS OF THE INVENTION

Figure 1:
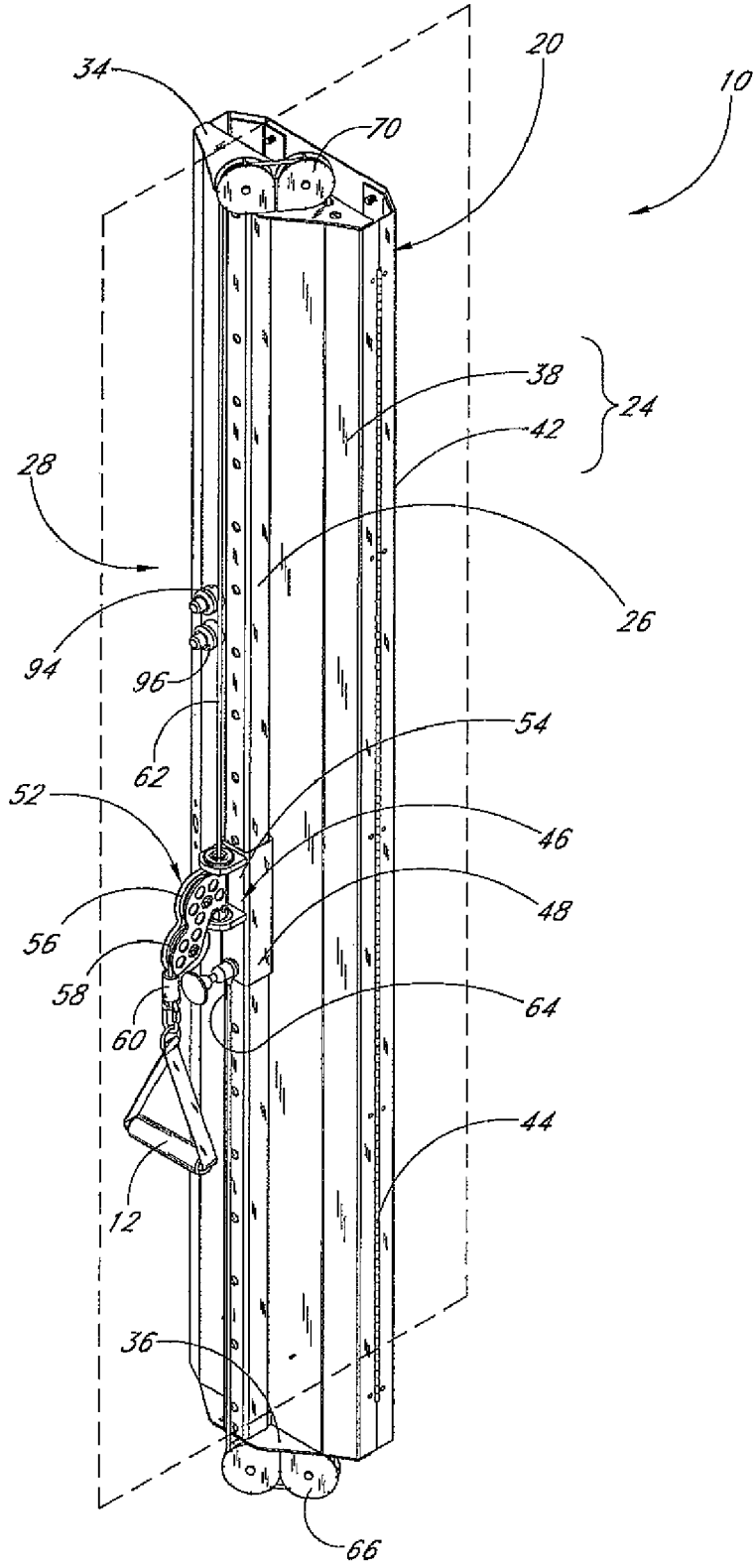
FIG. 1 is a perspective view of a front side of a resistance unit configured in accordance with a preferred embodiment of the present invention.

The present exercise apparatus can take a variety of forms and can be used in a variety of manners as will be apparent from the description of the following embodiments. Additionally, some of the embodiments include a combination of some of the aspects and features described above, and others will include additional aspects and features. As noted above, not all of the aspects and features of the present invention need to be employed in a single embodiment.

Each illustrated embodiment includes a pneumatic resistance unit that allows for variable resistance and variable degrees and extensions of motion by the user. In addition, the resistance units are designed to permit the user to perform a wide variety of exercises to work various muscles or muscle groups with the same piece of equipment. As will be apparent from the following description of the preferred embodiments, the resistance unit can be stationary or movable, and can include movable pulleys that allow the user to change the direction in which the user pushes or pulls during a set of the exercise repetitions. Various aspects, features and advantages of the following apparatuses, however, can be used with other types of resistance mechanisms (for example, but without limitation, weight stacks), as described below. Accordingly, the following will first describe the resistance unit as a stationary exercise apparatus and then will describe additional embodiments of the exercise apparatus that can employ the resistance unit. Like reference numbers will be used to indicate similar components among the illustrated preferred embodiments.

Resistance Unit

With reference initially to FIGS. 1-4C, the resistance unit 10 (i.e., power module) in this embodiment forms an exercise apparatus that can be mounted to a support structure, such as, for example, but without limitation, a wall, a frame or a post. The resistance unit 10 includes a user interface 12, which the user grips, an extension mechanism 14 that provides a range of movement to the user interface 12, a resistance assembly 16 that resists movements of the user interface 12, a coupling mechanism 18 that couples the resistance assembly 16 to the extension mechanism 14, and a housing 20. The housing 20 supports these components and preferably encloses the resistance assembly 16, the coupling mechanism 18, and at least a portion of the extension mechanism 14.

In the embodiments described herein, the user interface 12 takes the form of a handle. The user interface, however, can take other forms. For example, the user interface can be a band (preferably of an adjustable size) that is sized to fit around a portion of the user's body, e.g., a waistband or an ankle band. The user interface additionally can be a bar, a foot pedal, or other lifting equipment. The user interface thus can be any article or mechanism that a user acts against or interacts with and that is attached, either directly or indirectly, to the extension mechanism 14.

The user interface 12 preferably is moved between two positions during an exercise and can be moved from one extreme position to another extreme position. In the illustrated embodiment, the handle 12 normally resides in a retracted position with a cable end to which the handle 12 is attached being fully retracted up to the unit 10. A user can move the handle 12 from the retracted position to an extended position in which the cable end of extension mechanism 14 is pulled to its farthest position from the housing 20. The exercise movement can involve movement between any two positions between (and possibly including) the retracted and extended positions in order to accommodate different exercises and different size weight lifters.

Figure 2:
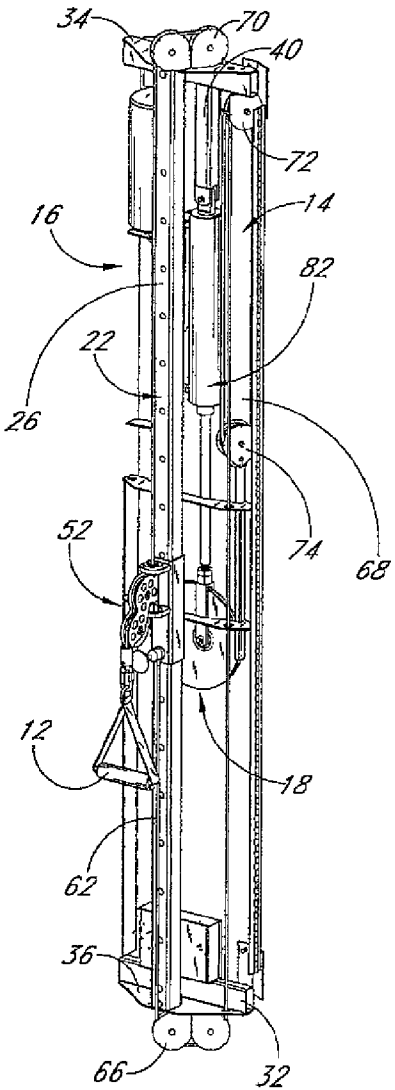
FIG. 2 is a perspective view of the resistance unit of FIG. 1 with a cover assembly removed to expose several internal components of the resistance unit.
Figure 3A:
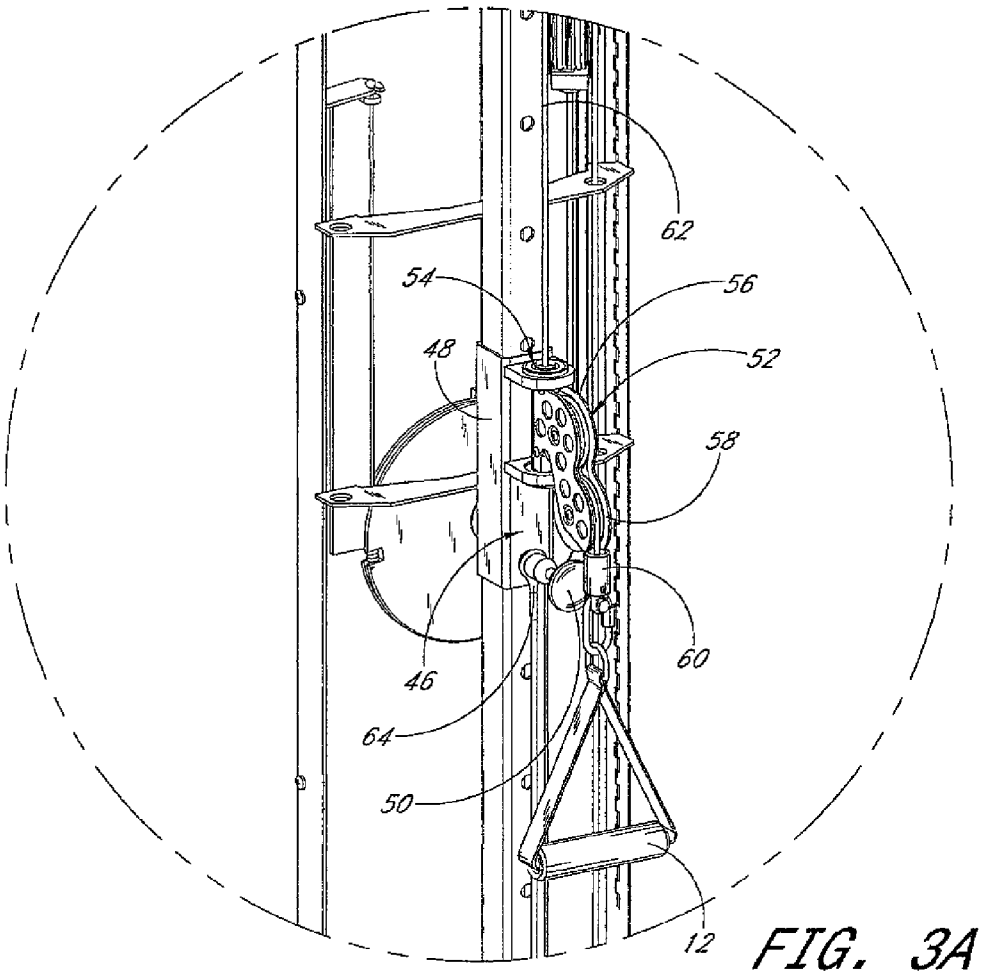
FIG. 3A is an enlarge view of the area within the circle 3A-3A of FIG. 3.
Figure 3:
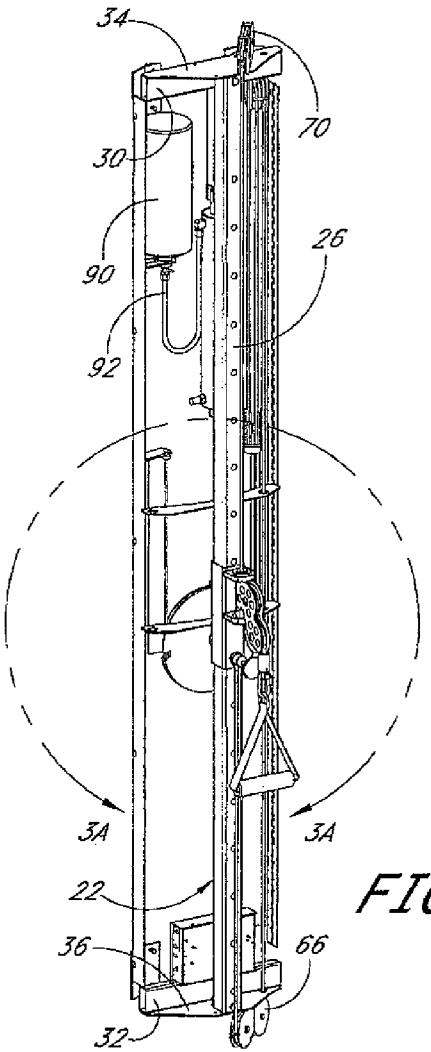
FIG. 3 is a perspective view similar to FIG. 2, but with the unit rotates to illustrate a left front side of the resistance unit of FIG. 1.

As seen in FIGS. 1-3, the housing 20 is substantially rigid and is defined by a frame 22 and a cover assembly 24. The frame 22 of the illustrated embodiment, as best seen in FIGS. 2 and 3, includes a vertical guidepost or tract 26 that is disposed on a front side 28 of the housing 20. An upper cross member 30 and a lower cross member 32 are connected at the upper and lower ends of the guidepost 26 via upper and lower brackets 34, 36, respectively. A front cover 38 is disposed behind (but spaced apart from) the guidepost 26 and is attached to the upper and lower cross members 30, 32 and brackets 34, 36. A plurality of internal ribs and brackets are attached to the front cover 38 and to the upper and lower cross members 30, 32 to support various components of the extension mechanism 14, the coupling mechanism 18, and the resistance assembly 16 within the housing 20, as well as any electronic controls for the resistance unit 10. The ribs not only increase the rigidity of the housing 20, but also include holes through which a cable of the extension mechanism 14 passes in order to ensure that the cable maintains its position within the housing 20. Additionally, a cylinder-mounting bar 40 depends from the upper cross member 30.

In the illustrated embodiment, the vertical guidepost 26 extends along a central plane that divides the unit 10 into first and second halves (right and left halves as viewed from the front). From the exterior, the halves preferably have symmetrical configurations. Inside, however, the cylinder-mounting bar 40 is disposed at a position slightly offset from the center plane (i.e., generally offset to one side of the vertical guidepost 26).

The cover assembly 24 additionally includes a back cover 42. A side hinge 44 connects the back cover 42 to the front cover 38. The opposite side of the covers 38, 42 are connected together by removable fasteners or one or more latches. In this manner, the interior of the unit 10 can be readily opened for servicing or inspection.

In the illustrated embodiment, as best seen in FIGS. 3 and 3A, the vertical guidepost 26 preferably comprises a square steel tube and has a series of locking holes formed through a sidewall thereof. The guidepost 26, however, can have other configurations (e.g., an I-beam configuration).

The guidepost 26 supports a cable guide mechanism 46 that includes a traveler 48. The traveler 48 is configured to slide over the guidepost 26. In the illustrated embodiment, the traveler 48 has a corresponding tubular shape and is sized to slip over the guidepost 26. In this manner, the traveler 48 can be moved vertically over the guidepost 26.

A knob 50 is fit onto the traveler 48. The knob controls a dowel (not shown) that selectively engages one of the locking holes formed in the front side of the guidepost 26. In this manner, the user can releasably select the vertical position of the traveler 48.

The traveler 48 supports a handle pulley assembly 52 of the cable guide mechanism 46 via a hinge connection 54. The hinge connection 54 allows the handle pulley assembly 52 to rotate about a vertical axis. The handle pulley assembly 52 comprises a pair of pulleys 56, 58 that are arranged one above the other with the lower one 58 positioned slightly forward of the upper one 56. In the illustrated embodiment, the offset between the upper and lower pulleys 56, 58 is less than the diameter of either pulley. The pulleys 56, 58 preferably have the same diameter; however, pulleys of different size diameters can also be used. The pulley assembly 52 includes a plurality of holes, as best seen in FIG. 3A, formed in its side brackets. The holes lighten the weight of the pulley assembly 52 in order to respond more quickly to the movement of the user and to do so with less resistance.

A first end 60 of a cable 62 (a "user cable") of the extension mechanism 14 is threaded between the pulleys 56, 58 of the handle pulley assembly 52. The handle 12 is connected to this first end 60 of the user cable 62. The handle 12 preferably is releasably connected to the end of the user cable 62 in order to exchange different types of user interface. The arrangement of the hinge connection 54 and handle pulley assembly 52 automatically aligns the user cable 62 with the handle pulley assembly 52 when the handle 12 is pulled from substantially any direction outwardly from the unit 10.

A second end 64 of the user cable 62 is connected to the traveler 48 and extends downwardly from the traveler 48 to a bottom pulley set 66 (see FIG. 3). The bottom pulley set 66 directs the user cable 62 to the rear and inside of the unit housing 20. With reference FIG. 4, from the bottom pulley set 66, the user cable 62 extends upwardly in the housing 20 to a series of pulleys that, in the illustrated embodiment, collectively comprise a block-and-tackle mechanism 68 of the extension mechanism 14. The user cable 62 is wound through the pulley blocks and is then directed upwardly to an upper pulley set 70, which directs the user cable 62 to the front side 28 of the housing 20 and downward to the handle pulley assembly 52. The user cable 62 terminates at its first end 60, which, as noted above, is connected to the handle 12. Since the user cable 62 is threaded through the block-and-tackle mechanism 68 and back to the traveler 48, the handle pulley assembly 52 can be moved vertically along the guidepost 26 without loosening the user cable 26 or affecting the block-and-tackle mechanism 68, as described in more detail below As used herein, "cable," means collectively, steel or fiber rope, cord, or the like. For example, the user cable 62 can be a formed of a synthetic material, such as a polymer. One suitable example for the user cable 62 is a polyester/nylon blend rope; however, a coated steel cable can also be used. For example, the user cable 62 can comprises ⅛-inch wire cable with a plastic sheathing, and most of the pulleys of the unit that support the cable can have a diameter of about five inches. Although any suitable cable and pulley size can be employed, it is preferable that the associated pulleys have a diameter about 40 times the diameter of the coated-wire cable. Smaller diameter pulleys, however, can be used with other types of cables, e.g., 3.5-inch diameter pulleys used with polyester/nylon blend rope.

Figure 4A:
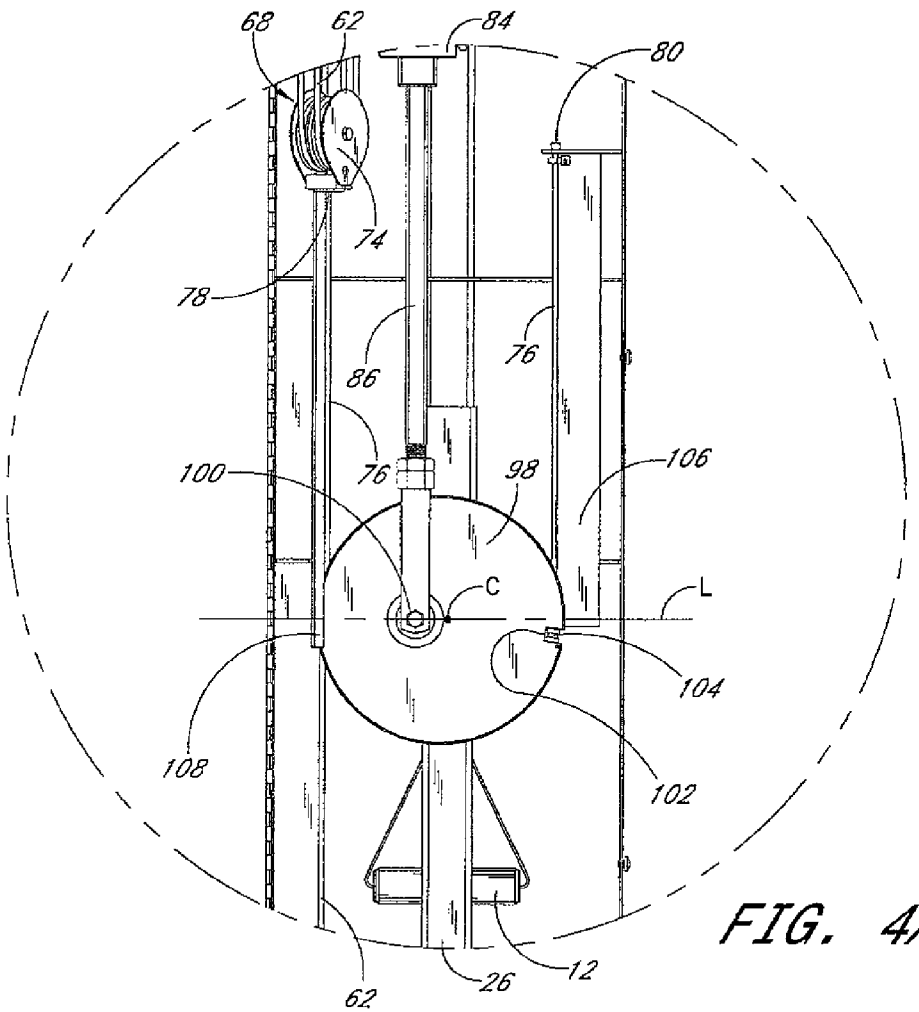
FIG. 4A is an enlarged view of the area within the circle 4A-4A of FIG. 4 and illustrates a coupling mechanism that couples a resistance assembly to an extension mechanism when the coupling mechanism is in an initial position.
Figure 4:
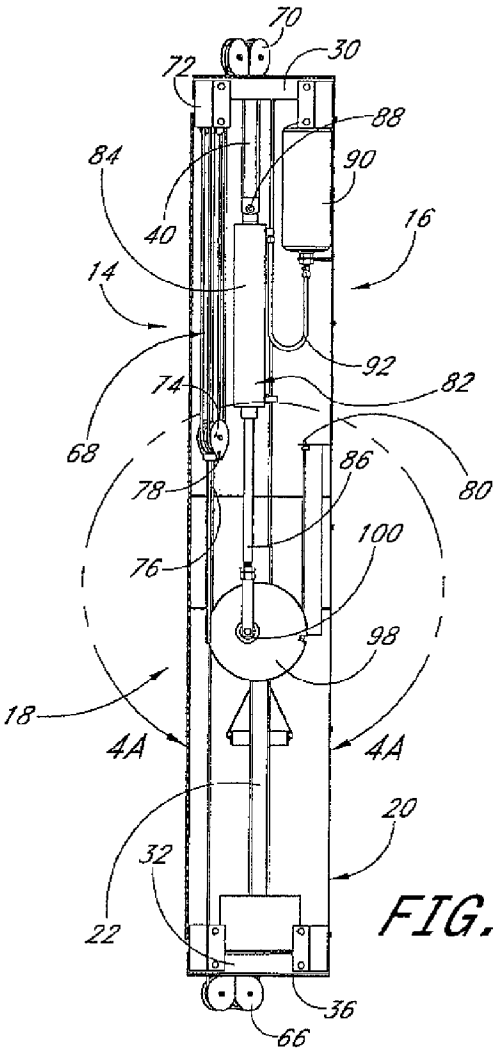
FIG. 4 is a rear plan view of the resistance unit of FIG. 1 with a rear cover removed.

As best seen in FIGS. 2 and 4, the block-and-tackle mechanism 68 includes an upper pulley block 72 and a lower pulley block 74. Each pulley block 72, 74, in the illustrated embodiment, includes two pulleys; however, each block 72, 74 can include fewer or more pulleys. The upper pulley block 72 is attached to upper cross member 30 or bracket 34 of the frame 22. The user cable 62 extends upward inside the housing 20 from the bottom pulley set 66 and wraps around one of the pulleys of the upper pulley block 72. The cable 62 then extends down and wraps around one of the pulleys of the lower pulley block 74, and then up and down again wrapping around the second pulleys of the upper and lower pulley blocks 72, 74, respectively. From the lower pulley block 74, the user cable 62 extends upward to the upper pulley set 70, as described above. Accordingly, as the user pulls the user cable 62 from the unit 10 (i.e., pulls the cable 62 toward the extended position), the block-in-tackle shortens in the process as the lower pulley block 74 moves upward toward the upper pulley block 72.

The lower pulley 74 remains generally stationary if the traveler 48 is moved without pulling on the handle 14. Both ends of the user cable 62 also move with the traveler 48. Accordingly, upward movement of the traveler 48 pulls up on the lower section of the user cable 62, which consequently pulls into the block-and-tackle mechanism 68 from the top any would-be slack in the upper section of the user cable 62.

As best seen in FIGS. 4 and 4A, the lower pulley block 74 constitutes an output member of the block-and-tackle mechanism 68 in the illustrated embodiment. In other words, the load to be "lifted" is connected to lower pulley block 74 in the illustrated embodiment.

The coupling mechanism 18 in the illustrated embodiment includes a main cable 76. A first end 78 of the main cable 76 is attached to the lower pulley block 74. The second end 80 of the main cable 76 is fixed to the housing 20. The main cable 76 cooperates with the resistance assembly 16 (see FIG. 4A). As the user pulls the handle 12, the user cable 62 winds through the pulley blocks 72, 74, lifting the lower pulley block 74 and correspondingly pulling on the main cable 76. Force from the resistance assembly 16 is communicated through the main cable 76 to the lower pulley block 74 and further to the user cable 62.

In the illustrated embodiment, the block-and-tackle mechanism 68 is arranged with four pulleys and four lengths of line between the pulleys. As such, the resultant force at the handle 12 is one-fourth of the force supplied by the resistance assembly 16, and the stroke length of handle 12 is about four times the stroke length of the pulley block output (i.e., the distance of between upper and lower pulley blocks 72, 74 when the handle 12 is in the retracted position). Of course, any pulley assembly can be used to achieve any desired force reduction or stroke elongation.

The resistance assembly 16 of the illustrated embodiment (i.e., illustrated in FIGS. 4 and 4A) includes a pneumatic actuator 82. In the illustrated embodiment, the pneumatic actuator 82 is a linear actuator that includes a cylinder 84 and a piston rod 86. The cylinder 84 includes a cylinder body and a piston that slides within the cylinder body. The piston divides the cylinder body into two variably volume chambers. At least one of the chambers only selectively communicates with the atmosphere so as to provide the desired resistance. The other chamber can be open to the atmosphere; however, in some applications, both chambers can be pressurized (e.g., be of equal pressure), can selectively communicate with the atmosphere and/or can communicate with each other. In the illustrated embodiment, however, one of the chambers communicates with the atmosphere (e.g., the air within the housing) so as not to resist movement of the piston.

The piston rod 86 is connected to the piston and extends through one of the variable volume chambers. The piston rod 86 moves linearly along a stroke axis as the piston slides within the cylinder bore. The stroke length of the piston rod 86 is sufficient to provide the desired stroke for the block-and-tackle mechanism 68 (as discussed above).

A cap closes the opposite end of the cylinder body (i.e., opposite of the end through which the piston rod extends). The cap includes a lug. A pivot pin 88 preferably secures the lug to the cylinder-mounting bar 40 such that the pneumatic actuator 82 can pivot within the housing 20 about the pivot pin 88. The pneumatic actuator 82 in the illustrated embodiment hangs from the bar 40 within the housing 20 so as to pivot within a plane that is generally parallel to the front side 28 of the housing 20; however, in some applications, the cylinder body can be rigidly fixed within the housing 20. The actuator 82 in this position thus has an upper chamber and a lower chamber. In the illustrated embodiment, the lower chamber is open to the atmosphere (preferably through a filter) and the upper chamber is pressurized.

At least several components of the pneumatic cylinder are preferably formed of a polymer (e.g., plastic) in order to lighten the weight of the resistance unit 10 and to decrease production costs. Such components can include the cylinder body, the piston and one or more of the end caps of the cylinder.

The upper chamber preferably communicates with at least one accumulator 90, as seen in FIG. 4. The accumulator 90 is preferably rigidly mounted within the housing 20 at a location next to the cylinder 84. In the illustrated embodiment, the accumulator 90 is mounted on one side of the cylinder 84 and the block-and-tackle mechanism 68 is disposed on the other side of the cylinder 84 within the housing 20. An air equalization line 92 connects the accumulator with the cylinder 84 so as to expand effectively the variable volume of the upper chamber. In this manner, the effective air volume of the cylinder is increased, and air pressure thus will not increase as dramatically when the piston is moved.

The accumulator 90 and the upper chamber also selectively communicate with a source of pressurized air and with the atmosphere. In the illustrated example, an air compressor, which can be remotely disposed relative to the exercise apparatus, communicates with the upper chamber through an inlet valve. A button 94 that actuates the inlet valve preferably is accessible from the front side 28 of the housing 20 (as seen in FIG. 1) and is marked with appropriate indicia (e.g., "+"). Pushing the button 94 adds air pressure to the charged side of the cylinder 84, e.g., the upper chamber in the illustrated embodiment. An outlet valve communicates with the charged side of the cylinder to selectively expel air to the atmosphere in order to decrease air pressure on the charged side of the cylinder 84. A button 96 that actuates the outlet valve also is preferably accessible from the front side 28 of housing 20 and is marked with appropriate indicia (e.g., "−"). A user thus can adjust, i.e., increase or decrease, the air pressure within the resistance assembly 16 by operating the appropriate valves.

The coupling mechanism 18 transfers a resistant force from the resistance assembly 16 to the extension mechanism 14 to oppose movement of the handle 12 by the user. As noted above, the coupling mechanism 18 includes the main cable 76 that is pivotally fixed at its first end 78 to the lower pulley block 74 and is rigidly fixed at its second end 80 to the housing 20. For this purpose, the main cable 76, in the illustrated embodiment, includes a ball swaged onto the first end 78. The ball fits through a keyway slot formed in the lower pulley block 74 and nests in a receptacle (not shown). The receptacle/ball connection secures the first end 78 of the main cable 76 to the lower pulley block 74, yet allows the cable 76 to pivot relative to the pulley block 74.

The coupling mechanism 18 also includes a main pulley or pulley wheel 98 that preferably is circular and has a larger diameter than the pulleys of the block-and-tackle mechanism 68. The main pulley 98 is rotatably attached to the end of the piston rod 86 to permit rotation of the main pulley 98 relative to the piston rod 86. For this purpose, the main pulley 98 includes a bearing 100 to which a bolt or pivot shaft couples to the piston rod end. A cable channel is disposed about the periphery of the main pulley 98, and the main cable 76 fits therein.

With reference to FIG. 4A, a cable lock notch 102 is disposed along the peripheral edge of the main pulley 98. In the illustrated embodiment, the cable lock notch 102 is disposed at the point that will provide a sufficient amount of the main cable 76 to unwind from the main pulley 76 to accommodate the stroke length of the piston rod 86. A cable lock member 104 is disposed about the main cable 76, and fits into the cable lock notch 102. In this manner, the position of the main cable 76 relative to the main pulley 98 is maintained.

A guide preferably is provided next to the pulley wheel and is arranged such that the pulley wheel rides along the guide. In the illustrated embodiment, the guide is an elongate cable support member 106 that extends inwardly from a first side of the housing 20, which is farthest from the extension mechanism (e.g., the left side, as viewed from the front, in the illustrated embodiment). The guide, however, need not in all applications support the cable 76 or hold the cable 76 within the peripheral channel of the main pulley 98.

The cable support member 106 is positioned immediately adjacent the downwardly extending portion of the main cable 76 adjacent the first side of the housing 20. The cable support member 106 preferably has a thickness that is about equal to the diameter of the cable 76, and is thin enough to fit at least partially within the peripheral channel of the main pulley 98. As the main pulley 98 is drawn upwardly, it rolls on the cable 76 and the support member 106. The support member 106 thus prevents any substantially "play" in the coupling mechanism 18 that would otherwise occur and, in fact, helps hold the main pulley 98 securely in place during operation of the device. Since the cable 76 generally does not slide relative to the cable support member 106, wear of the cable 76 and the pulley 98 is substantially lessened.

With continued reference to FIGS. 4 and 4A, a cable cover 108 preferably extends from a second side of the housing 20 (e.g., the right side, as viewed from the front, in the illustrated embodiment). The cable cover 108 shields the main cable 76. Also, the peripheral edge of the main pulley 98 preferably fits within the cover 108 so that the cover 108 can help keep the main pulley 98 properly aligned. Preferably, however, the cable cover 108 does not contact or support the main pulley 98 or the main cable 76.

As understood from FIG. 4, a first section of the main cable 76 extends from the main pulley 98 toward the first cable end 78 and a second section of the main cable 76 extends from the main pulley 98 toward the second cable end 80. In the illustrated embodiment, each of the first and second cable sections has a generally vertical orientation. The pneumatic actuator 82 is arranged such that its stroke axis lies generally parallel to the first section of the main cable 76 at least initially when the handle 12 is in its retracted position.

The above configuration of the extension mechanism 14, the resistance assembly 16 and the coupling mechanism 18 provides for a compact resistance unit 10. The resistance unit 10 can be readily used in a variety of applications, as made clear from the additional embodiments. It is also lightweight and involves relative few components, yet provides a full range of movement, versatility in the types of exercises that can be performed, and variability in the amount of resistance provided.

As discussed above, it can be expected that, as the piston moves within the cylinder 84, the resistance force will increase somewhat, although not as dramatic as it would without the accumulator. For some exercises, it is preferred that the resistance force be maintained at a generally constant level throughout the exercise stroke (e.g., the cable tension remains generally constant). As discussed below, the illustrated embodiment comprises a mechanism for controlling the resistance force over the stroke of the piston rod 86; however, the resistance unit 10 need not include such a mechanism in all applications.

To produce a more constant resistance force over the stroke length of the piston rod 86, the bearing 100 is offset from the center of the main pulley 98. The offset position causes the block-and-tackle mechanism 68 to gain additional leverage over the cylinder as the main pulley 98 rotates. As the piston is forced into the cylinder 84, the main pulley 98 rotates, thereby moving the bearing 100 away from the side of the main cable 76 that is connected to the block-and-tackle mechanism 68. The main pulley 98 thus acts as a simple beam with a movable fulcrum. The increase distance between the point where the block-and-tackle mechanism 68 pulls on the main pulley 98 and the point at which the pneumatic actuator 82 acts on the main pulley 98 (e.g., the bearing 100) causes the block-and-tackle mechanism 68 to increase leverage over the resistance assembly 16. Additionally, the offset position causes the pneumatic actuator 82 to pivot and produce a force vector that is skewed relative to the direction in which the main pulley 98 is being drawn. Accordingly, only a portion of the resistance force opposes the movement of the main pulley 98 toward the cylinder 84; the other force component forces the main pulley 98 toward a side of the housing 20. Consequently, the overall the effective resistance force remains generally constant throughout the entire stroke of the piston rod 86.

In the illustrated embodiment, the cylinder 84 is generally vertically oriented when the stroke begins, but pivots toward the first side of the housing as the stroke progresses. For this purpose, the bearing 100 is located such that a line L that passes through the center of the main pulley 98 and the bearing 100 lies generally normal to the stroke axis of the piston rod 86. In the illustrated embodiment, the line L extends horizontally. In other embodiments, the position of the cylinder 84 at the start and throughout the stroke can be varied. The cylinder, however, preferably does not cause the main pulley 98 to pull away from the cable support member 106.

A similar effect can be achieved by changing the profile of the guide (e.g., the cable support member 106) or the shape of the main pulley 98 such that the pneumatic actuator 82 pivots as main pulley 98 moves toward the cylinder 84. The result again is that the block-and-tackle mechanism 68 gains leverage and that only a portion of the resistance force opposes the movement. It also is understood that this effect can be achieved with gears and like mechanism in the place of the main pulley and main cable.

Rather than maintain a constant force, these techniques can also be used either alone or together to produce resistance force curves that increase and decrease throughout the exercise stroke. For example, when exercising the quadriceps muscle in the leg, the resistance force desirably increase toward the middle of the stroke and then decreases at the end. The initial orientation of the pneumatic actuator, the degree of offset of the bearing (if any), the initial position of the bearing, the shape of the main pulley, and/or the profile of the guide can be used to produce the desired force curve.

As seen in FIG. 4, the cable support member 106 preferably extends in a direction that is generally parallel to a plane that is perpendicular to the face of the main pulley 98 and that passes through a center point of the main pulley 98. The cable support member 106 is disposed on one side of the plane and the point of attachment (e.g., the pivot pin 88) of the pneumatic actuator 82 to the frame 22 is located on the other side of the plane. Additionally, the bearing 100 is on the same side of the plane as the point of attachment of the pneumatic cylinder 82 to the frame 22 at least when the handle 12 is in its retracted position. As also understood from the illustrated embodiment, as best seen in FIG. 4, the stroke axis of the piston rod 86 extends in a direction generally parallel to the plane.

In the illustrated embodiment, the stroke of the pneumatic cylinder piston rod 86 is about 12 inches, and the main pulley 98 has a diameter of about 8 inches. Over the full stroke of the piston 86, about 12 inches of cable 76 unwinds from the main pulley 98. Thus, with each piston stroke, the lower pulley block 74 moves about 24 inches, or about 2 feet. Since the block-and-tackle mechanism 68 is configured to increase the stroke length by 4 times, a total cable stroke at the handle 12 is about 8 feet. In this manner, a compact, light and reliable resistance unit 10 provides 8 feet of cable travel.

Additionally, the main pulley 98 is substantially circular, has a diameter of about 8 inches, and the bearing/connection point of the main pulley is disposed ⅞ of an inch off-center. As discussed above, this configuration of the main pulley 98, combined with the illustrated configuration of the pneumatic resistance assembly 16, provides a generally constant exercise force (e.g., ±10%) throughout the piston rod stroke. It is to be understood that the above dimensions apply only to the illustrated embodiment, are by way of example only and are not intended to limit the invention, and the principles discussed above can be employed to create any type of exercise apparatus having any desired stroke length and resistance curves.

It also is to be understood that in other embodiments it may be desired to have a changing force curve over the exercise stroke. Any number of parameters discussed above can be adjusted to custom-tailor such a changing force curve. For example, the offset of the connection bearing can be varied and/or an ellipsoid, irregular or other non-circular main pulley shape can be employed. Also, in the illustrated embodiment, the main pulley rotated through a range of angles from about 0° to about 170°. Variable resistance forces can also be achieved by beginning rotation at a different angle such as, for example, 5°, −5°, 90°, etc., relative to the horizontal.

The operation of the illustrated resistance unit will be described in connection with FIGS. 4A, 4B and 4C. As shown in FIG. 4A, when the resistance assembly 16 is in an unloaded position and/or when the handle 12 is in the retracted position, the generally horizontal line L intersects the bearing 100 and the center of the main pulley 98. This position of the main pulley 98 is considered to be 0° relative to horizontal. The piston rod 86 is preferably substantially vertically oriented in this unloaded position. As the user pulls the handle 12 so that the lower pulley block 74 moves upwardly, the main cable 76 is also drawn upwardly, thus vertically translating the main pulley 98 and also causing the main pulley 98 to rotate. In the illustrated embodiment, the bearing 100 rotates from about 0° through about 170° during the stroke of the piston rod 86.

The offset connection of the piston rod 86 to the main pulley 98 causes the pneumatic cylinder to pivot about the pivot point 88 when the main pulley rotates 98. As such, the cylinder 84 is directed at least partially toward a first side of the housing 20. As discussed above, the pneumatic actuator 82 exerts a substantial force during compression of the cylinder. The vertical component of the force is translated along the longitudinal length of the main cable 76. However, the horizontal component of the force tends to urge the main pulley 86 toward the first side of the housing and against the support member. Accordingly, although the force exerted by the pneumatic actuator 82 increases, not all of the force is directly opposing the upward movement of the main pulley 98. Moreover, the movement of the bearing 100 away from the block-and-tackle mechanism 68 increases the leverage that the block-and-tackle mechanism 68 has over the pneumatic actuator 82.

Figure 4B:
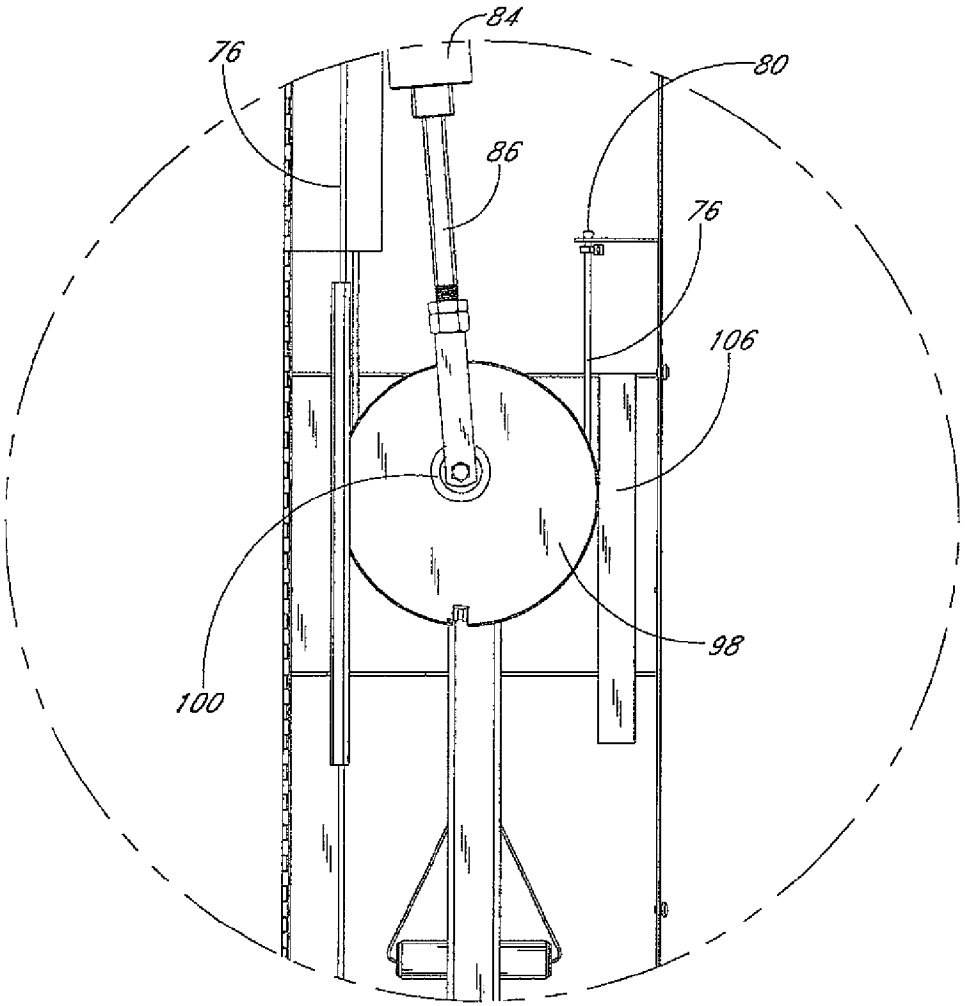
FIG. 4B illustrates the coupling mechanism of FIG. 4A as oriented approximately halfway through an exercise stroke.

FIG. 4B illustrates the position and orientation of the piston rod 86 and the main pulley 98 at a point about halfway through the piston rod stroke. The main pulley 98 has rotated through about 90° such that the bearing 100 is located almost above the center of the main pulley 98. The main pulley 98 also has rolled along the cable support member 106 and is closer to the cylinder 84. Because of the position of the bearing 100, the cylinder 84 has pivoted with the rotation of the main pulley 98. Accordingly, the stroke axis of the piston rod 86 is no longer vertically oriented and is skewed relative to the first and second sections of the main cable 76. Additionally, the distance between the bearing 100 and the section of the main cable 76 attached to the lower pulley block 74 has also increased to provide the block-and-tackle mechanism 68 with additional leverage over the pneumatic cylinder 82.

Figure 4C:
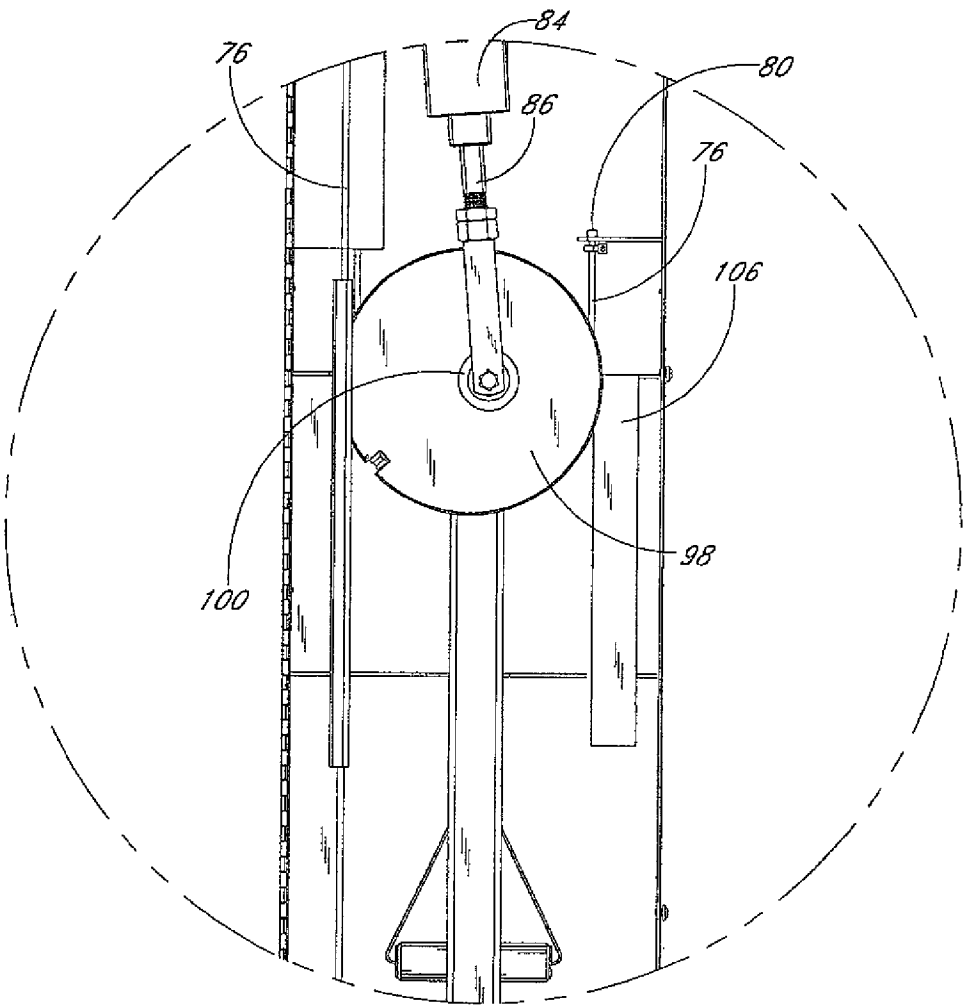
FIG. 4C illustrates the coupling mechanism of FIG. 4A as orientated generally at the end of an exercise stroke (e.g., fully extended).

FIG. 4C illustrates the position and orientation of the piston rod 86 and the main pulley 98 at a point near the end of the piston rod stroke. The main pulley 98 has rotated through about 170° such that the bearing 100 is located almost opposite of where it started. The main pulley 98 also has rolled along the cable support member 106 and lies near the lower end of the cylinder 84. Because of the position of the bearing 100, the cylinder 84 has pivoted further with the rotation of the main pulley 98 and the stroke axis of the piston rod 86 is even more skewed relative to the first and second sections of the main cable 76. Additionally, the distance between the bearing 100 and the section of the main cable 76 attached to the lower pulley block 74 has also increased to provide further leverage of the block-and-tackle mechanism over the pneumatic cylinder 82.

Accordingly, as the main pulley 98 rotates, the load exerted by the pneumatic cylinder on the pulley block shifts away from the pulley system (e.g., the block-and-tackle mechanism 68) as a result of its offset connection to the pulley 98, and the pulley system's leverage thereby increases. As such, the resistance force exerted by the resistance assembly 16 on the handle 12 is generally constant throughout the exercise stroke.

Exercise System

In accordance with another aspect of the exercise apparatus, there is provided an exercise system 200 in which the resistance unit 10 can be moved so as to vary its versatility. The system 200 preferably includes at least one resistance unit similar to that described above; however, various aspects, features and advantages of the system 200 can be used with other types of resistance mechanisms including, for example, but without limitation, weight stacks, hydraulics, elastic members or the like. Additionally, the illustrated exercise system 200 includes two resistance units, but one unit or more units can also be used.

Figure 5:
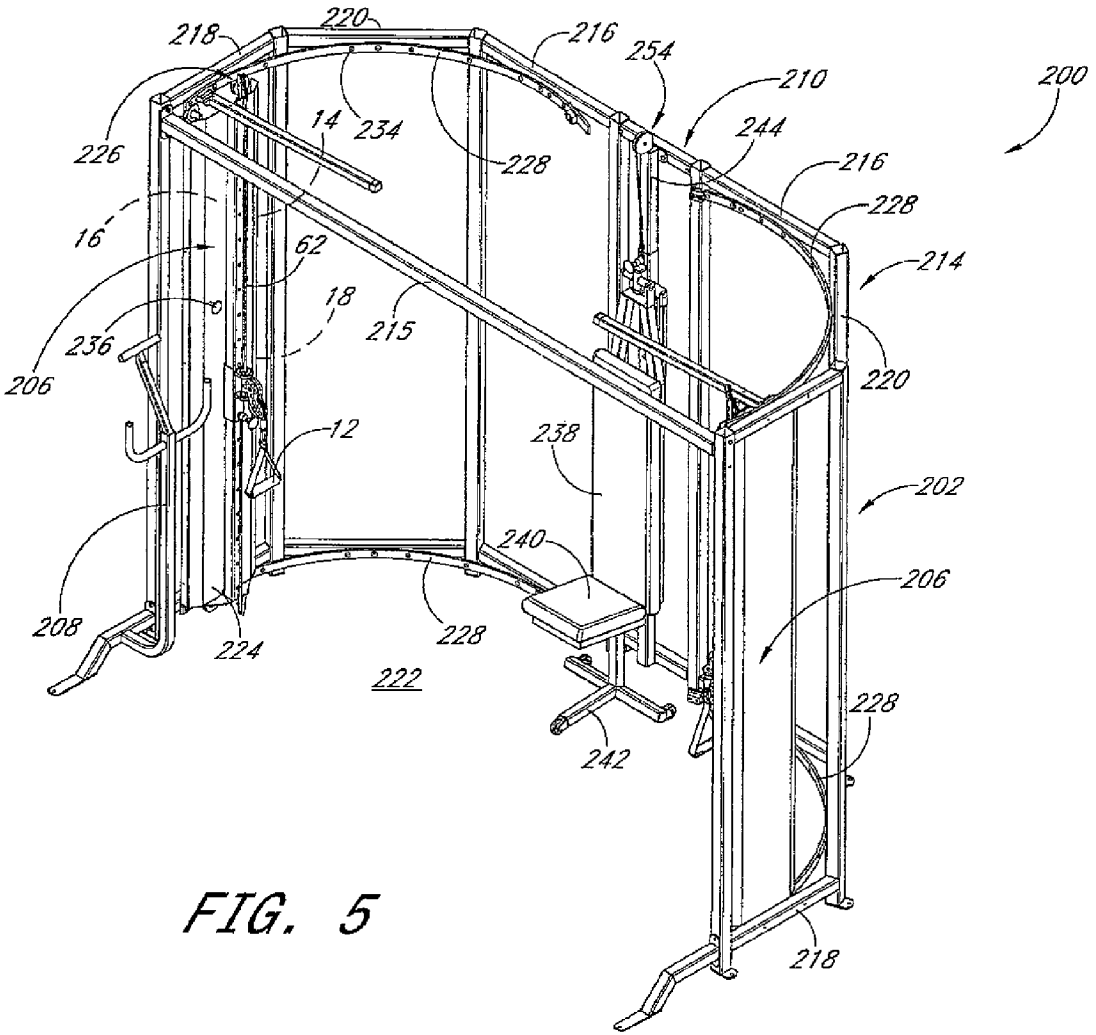
FIG. 5 is a front-side perspective view of exercise apparatus (or system) that defines an exercise zone and that is configured in accordance with another preferred embodiment of the present invention.

With reference to FIGS. 5-8, an exercise system 200 comprises a rigid station frame 202 supporting a seat assembly 204 and two resistance units 206. The frame can also support other exercise equipment that can be used alone or with the resistance units 206. For example, FIG. 5 illustrates a brace 208 that a user can hold when using the adjacent resistance unit 206.

In the illustrated embodiment, the station frame 202 is constructed of rigid square steel tubing. Of course, any suitable material can be used for the frame 202. The frame 202 has a generally U-shape as viewed from the top (see FIG. 7)

and includes a back section 210, a first side section 212 and a second side section 214. An upper cross member 215 links the first and second side sections 212, 214 together in order to strengthen the station frame 202. In the illustrated embodiment, each side section includes a three portions: a first portion 216 that lies generally within the same plane as the back section 210, a second portion 218 that lies generally normal to the first portion 216, and a third portion 220 that extends between and lies oblique to the first and second portions 216, 218. An exercise area or zone 222 is defined within the first and second side sections 212, 214 and the back section 210.

Figure 6:
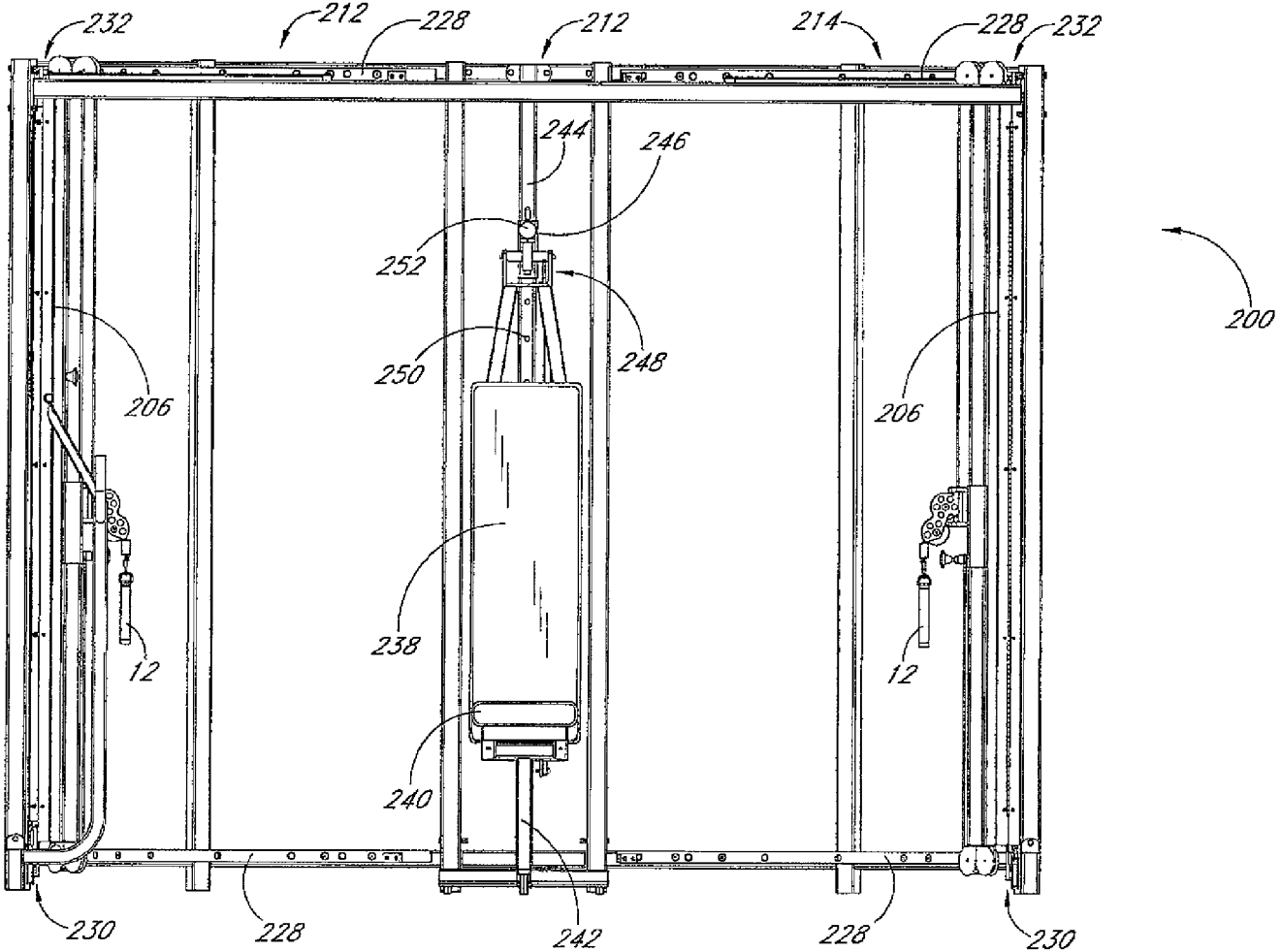
FIG. 6 is a front plan view of the exercise apparatus of FIG. 5.

As best seen in FIGS. 5 and 6, the seating assembly 204 is arranged generally centrally within the frame 202. The two resistance units 206 are provided on generally opposite sides of the seat assembly 204.

Each of the resistance units 206 includes an extension mechanism 14 that provides a range of movement to the user interface 12, a resistance assembly 16 that resists movements of the user interface 12, a coupling mechanism 18 that couples the resistance assembly 16 to the extension mechanism 14, and a housing 224. The housing 224 supports these components and preferably encloses the resistance assembly 16, the coupling mechanism 18, and at least a portion of the extension mechanism 14. These mechanisms and assembly 14, 16, 18 preferably are configured and arranged in accordance with the above description of the resistance unit 10. The housing 224 is similar to the housing 20 of the embodiment described above; however, the housing 224 preferably has a support mechanism 226 that permits the housing 208 to move relative to the frame 202 and to be selectively locked in a position on the frame 202. The support mechanism 226 will be described below.

The user interface 12 (e.g., a handle), in each of the resistance units 206, is connected to a corresponding user cable 62, as described above. The cable 62 is operatively connected to the resistance assembly 16 of the resistance unit 206 in the same manner as described above. As the user pulls upon the handle 12 with a force, the resistance assembly 16 applies an oppositely directed resistance force.

In operation, the user sits or stands generally centrally in an exercise area 222 defined within the frame and grasps the handles 12 of the opposing resistance units 206. As the user pulls on the handles, the resistance units 206 resist the user's efforts with a resistance force, thus providing fitness training for the user. Alternatively, the user can use just one of the resistance units.

The user can adjust the configuration and positioning of the seat assembly 204 and the resistance units 206. This adjustability enables the user to perform a variety of exercises that will exercise a variety of muscle groups.

Figure 7:
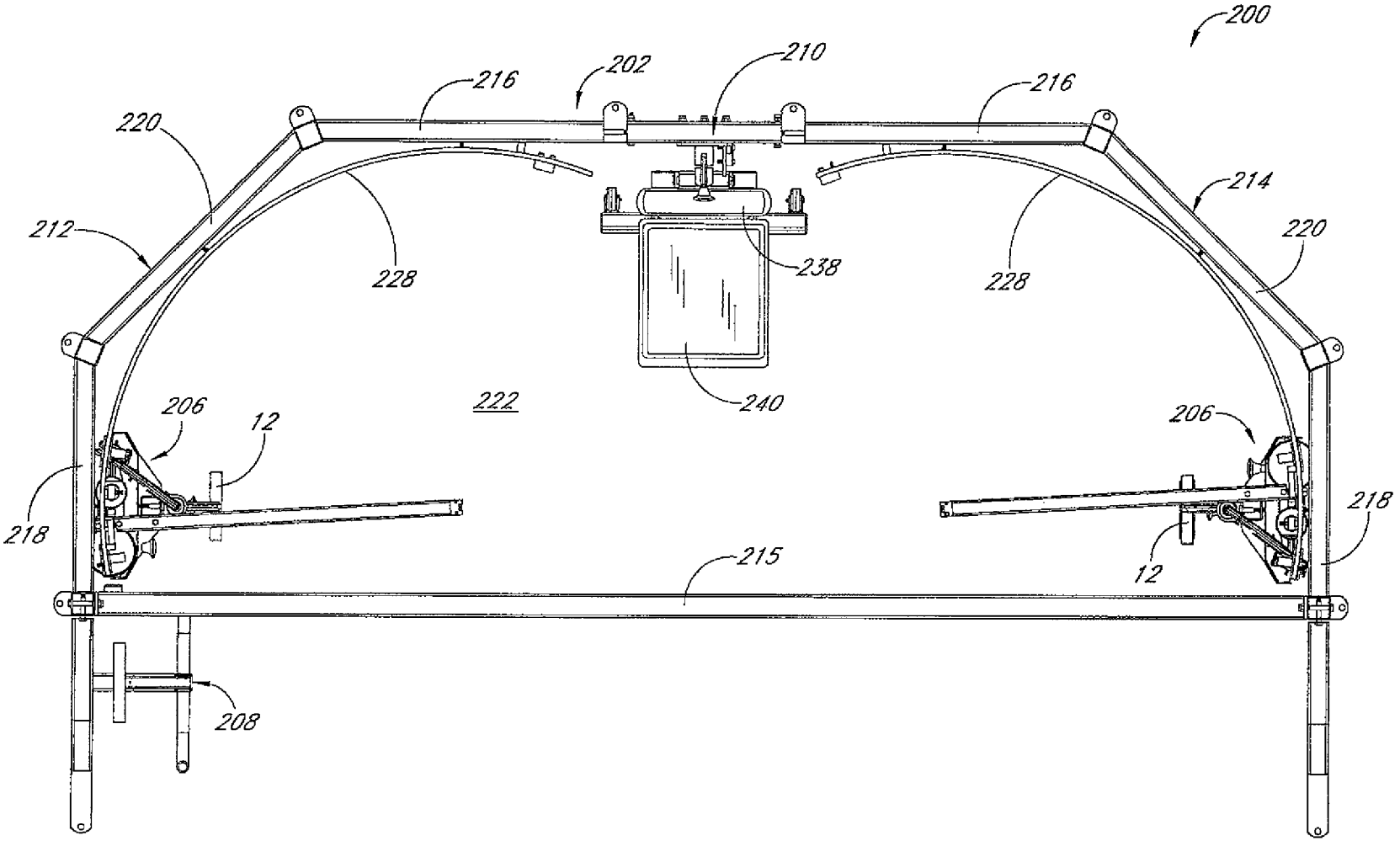
FIG. 7 is a top plan view of the exercise apparatus of FIG. 5.

In particular, the resistance units 206 can be moved relative to the frame 202 and relative to the seat assembly 204. For this purpose, as best seen in FIGS. 5 and 7, at least one arcuate track 228 is connected to the frame 202. In the illustrated embodiment, pairs of arcuate tracks 228 are connected at the top and the bottom of the frame 202, and more particularly to the portions 216, 218, 220 of each side section 212, 214. The track pairs 228 are on opposite sides of the seat assembly 214.

For each resistance unit 206, a lower roller assembly 230 of the support mechanism 226, which includes a pair of lower track wheels (see FIGS. 6 and 8), is mounted onto the resistance unit housing 224 and engages the lower track 228 so as to roll along the track 228. Similarly, an upper roller assembly 232 that includes a pair of upper track wheels (see FIGS. 6 and 8) is mounted onto the resistance unit housing 224 and engages the upper track 228 to roll along the track 228. In this manner, each resistance unit 206 is held securely to the frame 202, but is movable along the tracks 228.

As best seen in FIG. 5, a plurality of preset holes 234 is formed through each track 228. A lock rod of each resistance unit 206 is configured to be selectably engageable with the holes 234 so as to fix releasably the resistance unit 206 in a specific desired position along the track 228. A lock rod support is mounted on the housing 224, and the lock rod extends therethrough. An armature connects the lock rod to a rotating control rod. The control rod connects the upper lock rod with a lower lock rod. Each lock rod is configured to engage the holes 234 in the corresponding track 228. The armature and rotating control rod are configured so that when the control rod rotates, the lock rods are moved into or out of the corresponding holes 234.

The control rod extends through the housing 224. Rotation of the control rod is accomplished by manipulating a knob 236 (see FIG. 5) on the front of the housing 224. The knob 236 actuates an actuator, which extends into the housing to rotate the control rod. In this manner, a user can release the lock rods from and engage the lock rods with the corresponding holes 234 so as to move and lock the corresponding resistance unit 206 in a desired position along the tracks 228. However, various other locking mechanisms can be used to releasably secure the resistance units 206 in desired positions. For example, a friction brake, spring and ball detent, or the like can be used.

In the illustrated embodiment, both of the arcuate tracks 228 have a radius of approximately 33 inches and extend along an arcuate range of more than 90° and less than 180° (e.g., 120°. It is to be understood, however, that tracks of various sizes and configurations can also be used. For example, the track can be substantially straight or can have an irregular configuration. Additionally, the illustrated embodiment employs an upper track and a lower track. Additional embodiments can employ different configurations such as, for example, only an upper track, a single track about the midsection of the frame, three or more tracks, etc.

Still further embodiments can employ quite different mechanisms for moving the resistance unit(s) 206. For example, a rack and pinion or electromagnetic support structure can be configured to allow adjustability of the resistance unit(s). Any suitable member or system that allows the resistance unit(s) 206 to be easily wheeled, slid, or otherwise translated along a predefined track can advantageously be employed.

Additionally, movement of the units 206 can be controlled by hand or can be automated. For example, an electric motor can be employed to move the resistance unit(s) as desired and to hold the units in place. In an additional embodiment, a motor can be configured to move the resistance unit(s) during an exercise routine so that the user can simultaneously exercise a range of muscles.

Figure 8:
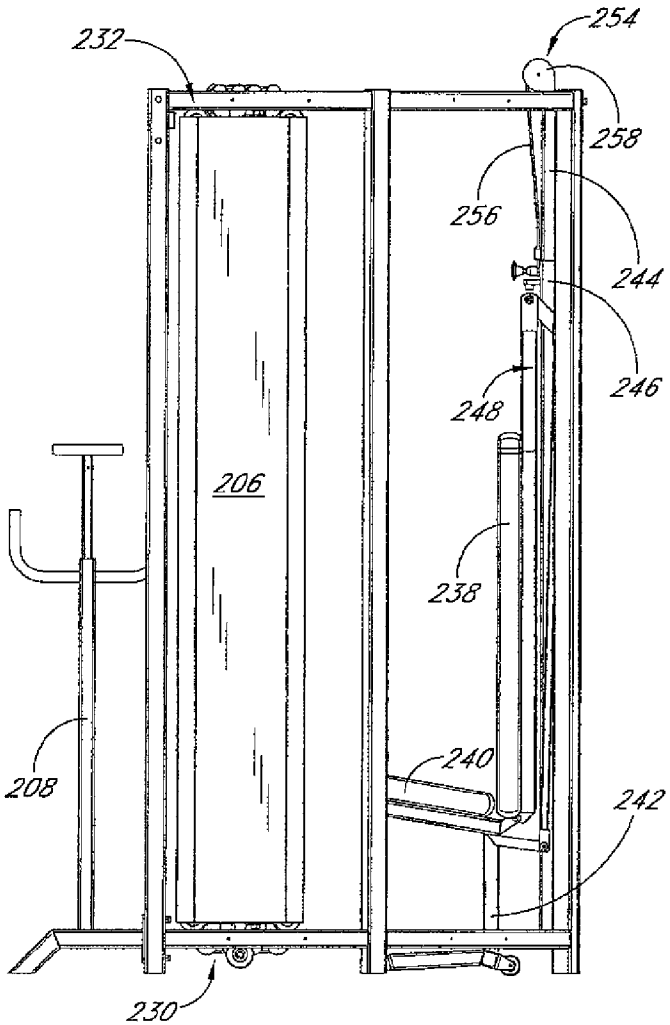
FIG. 8 is a side plan view of the exercise apparatus of FIG. 5.

As seen in FIGS. 6-8, the seat assembly 204 comprises a seat back portion 238 and a seat bottom portion 240. The bottom portion 240 preferably is angled about 0-20° and more preferably about 10° relative to horizontal and includes a pedestal 242 preferably comprising three wheeled leg members. The back portion 238 and the bottom portion 240 are connected to each other through a linkage so that the bottom portion 240 can moved (e.g., rolled) between a plurality of seat positions, and the angle between the back 238 and bottom portion 240 will change with differing seat positions.

A tubular vertical track, or guidepost 244, is mounted on the exercise apparatus frame 202, and more particularly to the back frame section 210, and a traveler 246 is configured to slide along the guidepost 244. The seat back portion 238 and linkage 248 of the seat assembly 204 are connected to the traveler 246. As the traveler 246 is moved, the position and arrangement of the seat assembly 204 changes. For example, the seat assembly 204 can be positioned out of the way of the exercise area 222 so that a user can use the exercise system 202 while standing. The traveler 246 can be lowered to move the seat assembly 204 into the exercise area 222 so that a user can sit on the seat assembly 204 in a partially reclined attitude while exercising. Finally, the seat assembly 204 can be essentially flattened out so that the user can lie on the seat assembly 204 while using the exercise system 200.

In the illustrated embodiment, as best seen in FIG. 6, the guidepost 244 has a number of locking holes 250 formed therethrough that define a plurality of discrete positions for seat back portion 238 on the frame 202. A knob 252 and locking dowel (not shown) are supported on the traveler 246, and the dowel selectively engages the locking holes 250 to releasably secure the seat assembly 204 in a variety of preset positions. For example, preset seat positions may position the seat back 238 at an angle relative to horizontal of about 0° (lying down), 30°, 45°, 60°, 75° and 90° (when the seat is positioned out of the exercise area). In another embodiment, a rubber stopper is used to prevent the seat back 238 from extending beyond about 0°. Of course, any of a multitude of mechanisms can be employed to hold the seat in a variety of positions.

With more specific reference to FIGS. 5 and 8, a counterweight system 254 can be provided to assist the user while adjusting the seat position. (This system is not illustrated in FIGS. 6 and 7 in order to simplify these drawings.) The counterweight system 254 comprises a counterweight cable 256 (FIG. 8) attached to the seat assembly traveler 246. The counterweight cable 256 extends upwardly and is wound about a counterweight pulley 258 positioned atop the frame back section 210. The counterweight cable 256 is directed by the pulley 258 into the tubular vertical track 244, within which a counterweight rides.

Multi-Function Exercise Station

With reference to FIGS. 9-12, the resistance unit described above can be a floor unit, either mounted directly to the floor or to a support stand. The construction of the present resistance unit 300 is similar to that described above except for the construction of the extension mechanism and the cable guide mechanism.

Figure 11:
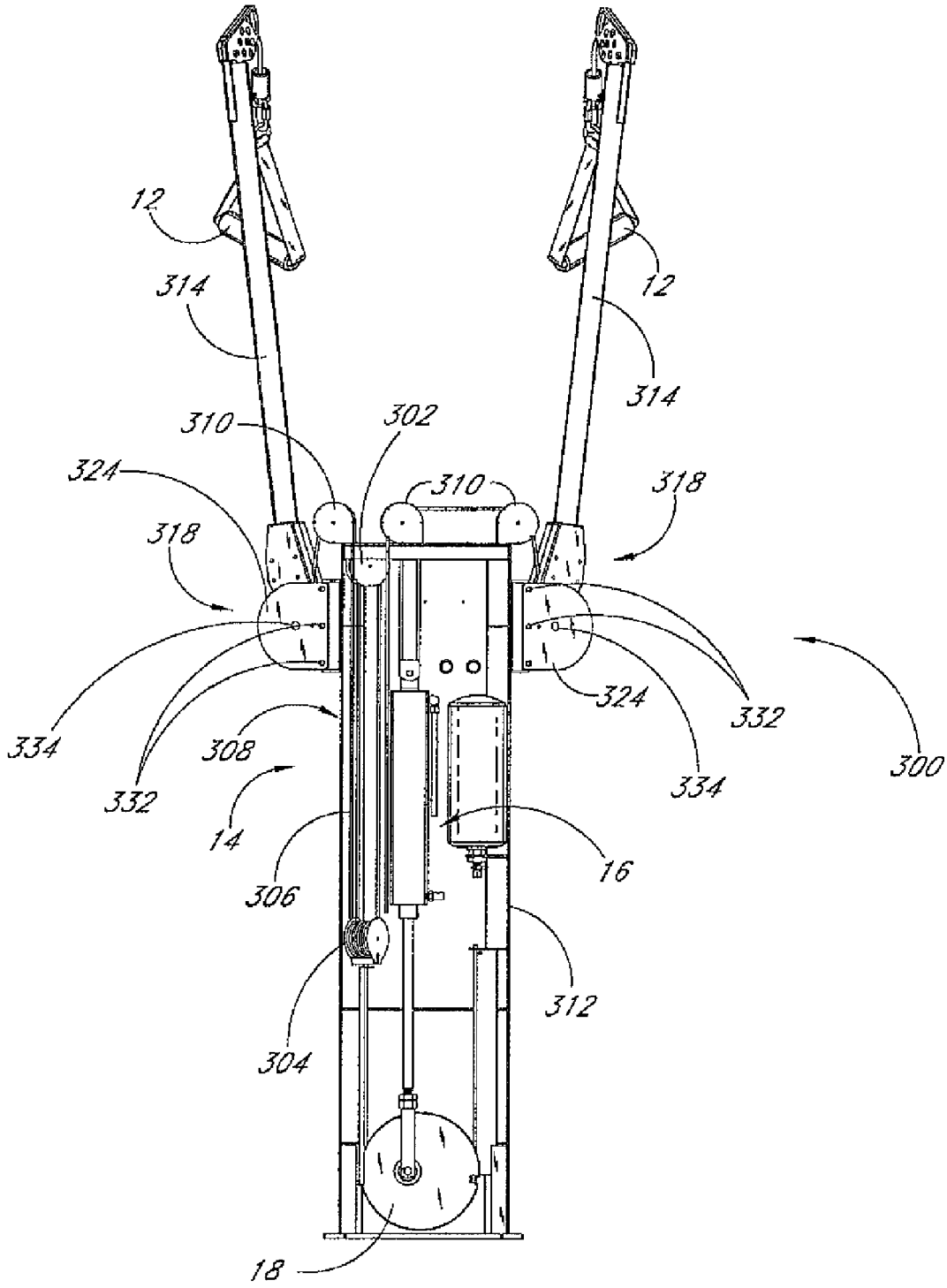
FIG. 11 is a rear plan view of the exercise apparatus of FIG. 9 with a rear cover removed.

In this embodiment, as best seen in FIG. 11, the upper pulley block 302 includes one fewer pulleys than the lower pulley block 304. In this manner, both ends of the user cable 306 extend upward as they exit the block-and-tackle mechanism 308. Upper pulleys 310 are disposed to either side of the extension mechanism 14 so as to guide the ends of the user cable 306 out of respective upper openings in a housing 312. This design allows for either end of the user cable 306 to be pulled (e.g., either handle 12 to be pulled) or for both cable ends to be pulled simultaneously or in a sequence.

The housing 312 houses a resistance assembly 16 and a coupling mechanism 18. The construction and layout of the resistance assembly 16 and the coupling mechanism 18 are the same as that described above in connection with the first embodiment.

The housing 312 also supports a pair of adjustable arms 314. The arms 314 are disposed on opposite sides of the housing 312 and extend outward from the housing 312. In the illustrated embodiment, each arm 314 extends at a 30° angle relative to the front side 28 of the housing and thus lie 120° apart from each other. This arrangement is advantageous because it permits three units 300 to be mounted close to each other in a triangular arrangement. That is, each unit 300 is arranged along one leg of an equilateral triangle with the rear side of the units 300 facing one another. Because the arms 314 of each unit 300 are spaced apart by 120°, the movement of the arm 314 of one unit 300 does not interfere with the movement of an adjacent arm 314 of the next unit 300.

Figure 9:
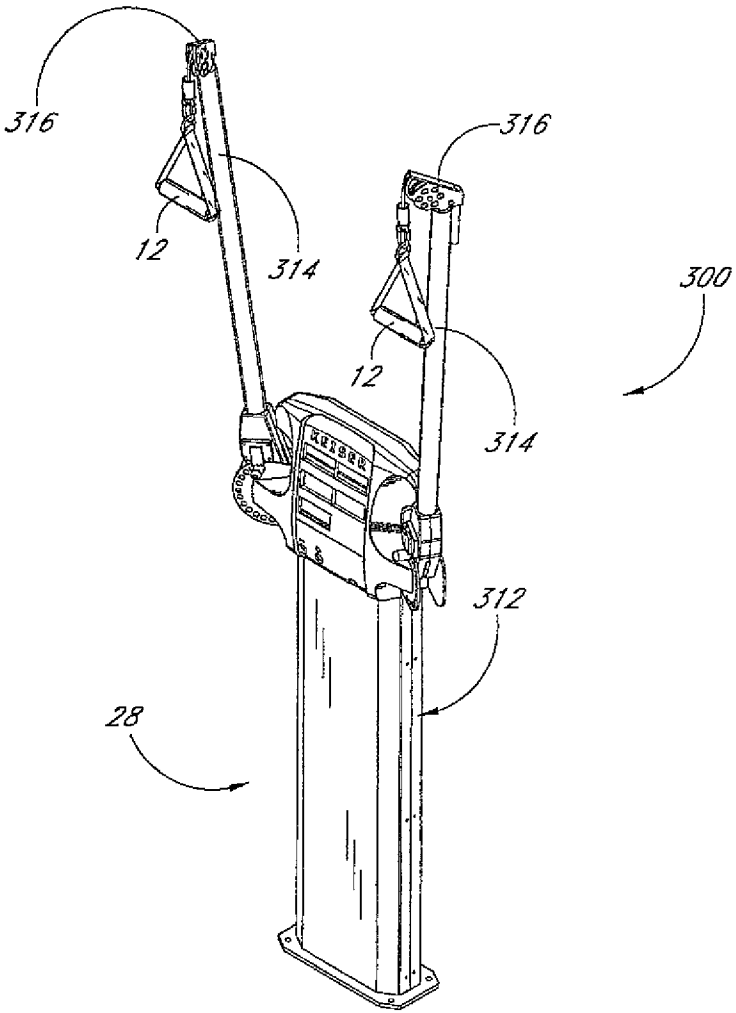
FIG. 9 is a perspective view of an exercise apparatus configured in accordance with an additional embodiment of the present invention.

Each arm 314 has a tubular structure through which the user cable 306 passes. The outer end of the arm supports a handle pulley assembly 316 via a hinge connection. The hinge connection allows the handle pulley assembly 316 to rotate about an axis of the arm 314. The handle pulley assembly 316 comprises a pulley that is offset to one side of the arm axis. As with the above-described pulley assembly, the present pulley assembly 316 includes a plurality of holes, as best seen in FIG. 9, formed in its side brackets. The holes lighten the weight of the assembly 316 in order to respond more quickly to the movement of the user and to do so with less resistance.

The first end of the user cable 306 is threaded over the pulley of the handle pulley assembly 316 and one of the handles 12 is connected to this first end of the user cable. In the illustrated embodiment, the handle 12 preferably is releasably connected to the end of the user cable 306 in order to exchange different types of user interface. The arrangement of the hinge connection and handle pulley assembly 316 automatically aligns the user cable 306 with the handle pulley assembly 316 when the handle 12 is pulled from substantially any direction outwardly from the arm 314. The second end of the user cable 306 is similarly arranged and is similarly connected to the other handle 12.

Figure 10A:
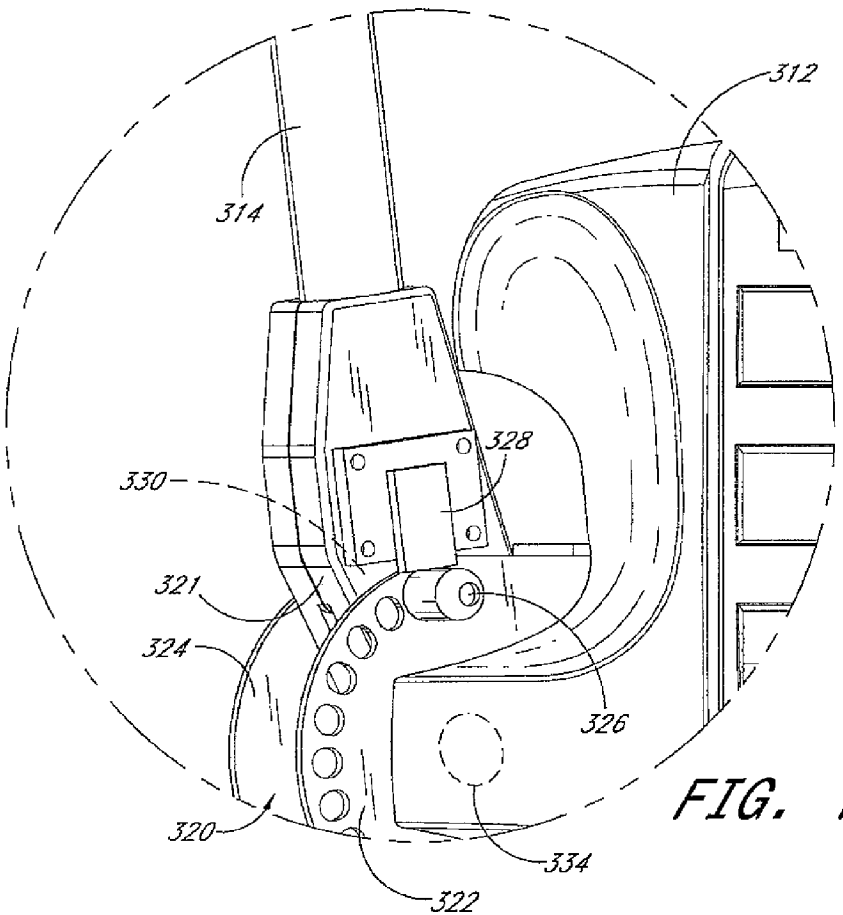
FIG. 10A is an enlarged view of the area within circle 10A-10A of FIG. 10 and illustrates a hinge assembly of the exercise apparatus of FIG. 9.
Figure 10:
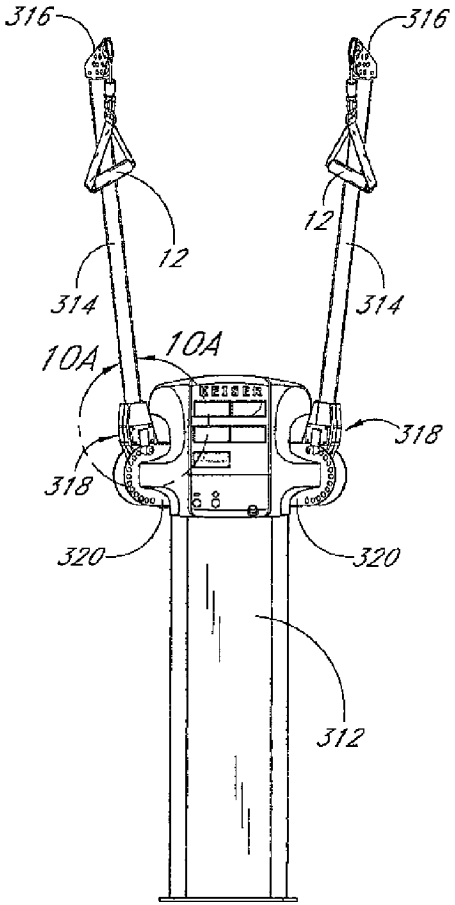
FIG. 10 is a front plan view of the exercise apparatus of FIG. 9.

As best seen in FIGS. 10 and 10A, a hinge assembly 318 hinges the opposite end of each arm 314 to the housing 312. Each hinge assembly 318 provides about 180° of movement (slightly less in the illustrated embodiment) in order to vary the vertical position of the corresponding handle pulley assembly 316. For example, in order to do biceps curls, the arms 314 would be positioned to extend straight down and the user would pull the handles 12 upward from the pulley assemblies 316. In order to do lateral-pull-downs or triceps pushes, the arms 314 would be positioned to extend straight up and the user would pull down on the handles 12. The arms 314 preferably can be selectively locked in a number of positions between these two extremes.

For this purpose, each hinge assembly 318 includes a locking mechanism. In the illustrated embodiment, each hinge assembly includes a bracket 320 that receives a lug 321. The bracket 320 is formed by at least two bracket plates: a front bracket plate 322 and a back bracket plate 324. The bracket 320 is disposed on (and preferably at least partially integrated with) the housing 312 and the lug 321 is disposed on the inner end of the arm 314. At least one of the bracket plates 322, 324 includes a plurality of locking holes 325 that are spaced in an arcuate pattern along an outer edge of the bracket plate. The lug 321 supports a knob 326 that controls a dowel (not shown). The dowel selectively engages one of the locking holes 325. In this manner, the user can releasably select the vertical position of the arm 314. In the illustrated embodiment, the knob 326 is supported on the front side of the front bracket plate 322 by a support bracket 328 on the lug 321. The user pulls out the knob 326 to disengage the dowel from a locking hole 325 and releases (if a spring bias is provided) or pushes the knob 326 to engage the dowel with the locking hole 325.

Each hinge assembly 318 includes an inner pulley 330 over which the user cable 306 runs from the corresponding upper pulley 310 into the arm 314. In the illustrated embodiment, the position of the pulley 330 within the hinge assembly 318 is disposed at a position below the corresponding upper pulley 310 in the housing 312. Thus, the user cable 306 extends over the upper pulley 310 and under the hinge assembly pulley 330 when the arm 314 is at least in an upward extending orientation.

Figure 12:
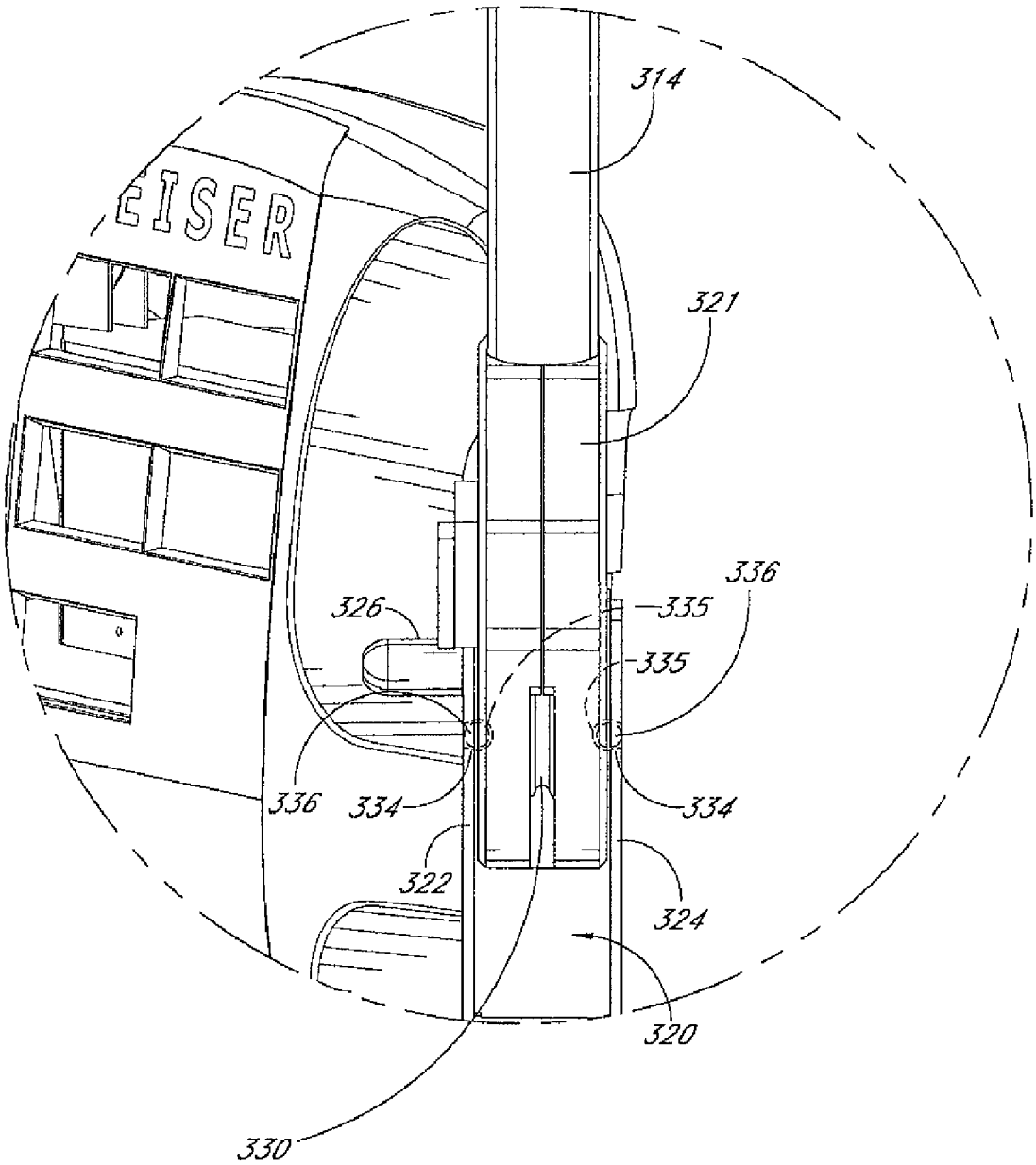
FIG. 12 is a plan view of the hinge assembly of FIG. 9.

Each hinge assembly 318 does not include an axle in order to accommodate the full range of movement of the arm 314 and to not pinch the user cable 306 during such movement. The hinge assemblies 318 also are zero-clearance (i.e., have no slop) in order that the user to does not sense any "play" in the structure as he or she pulls on the handles 12. For this purpose, as best seen in FIGS. 11 and 12, the front bracket plate 322 is connected to the housing 312. The rear bracket plate 324 is connected to the front bracket plate 322 by fasteners 332. Each bracket plate 322, 324 includes a hole 334 (the hole 334 in the front bracket 322 is covered by a shroud as seen in FIG. 10A), and the holes 334 are aligned when assembled. The lug 321 includes two corresponding semi-spherical dimples 335 that are arranged on opposite sides of the lug 321. As best seen in FIG. 12, a ball bearing 336 is disposed between each hole 334 and the corresponding dimple 335 such that the ball bearing 336 is captured between the corresponding bracket plate 322, 324 and the lug 321. Each ball bearing 336 has a diameter larger than the hole 334 and is sized to partially nest within the respective dimple 335. The ball bearings 336 together act as the pivot about which the arm 314 rotates. By tightening the fasteners 332 and thereby drawing the bracket plates 322, 324 together, play or looseness between the lug 321 and bracket 320 can be substantially eliminated.

Variations

Figure 13:
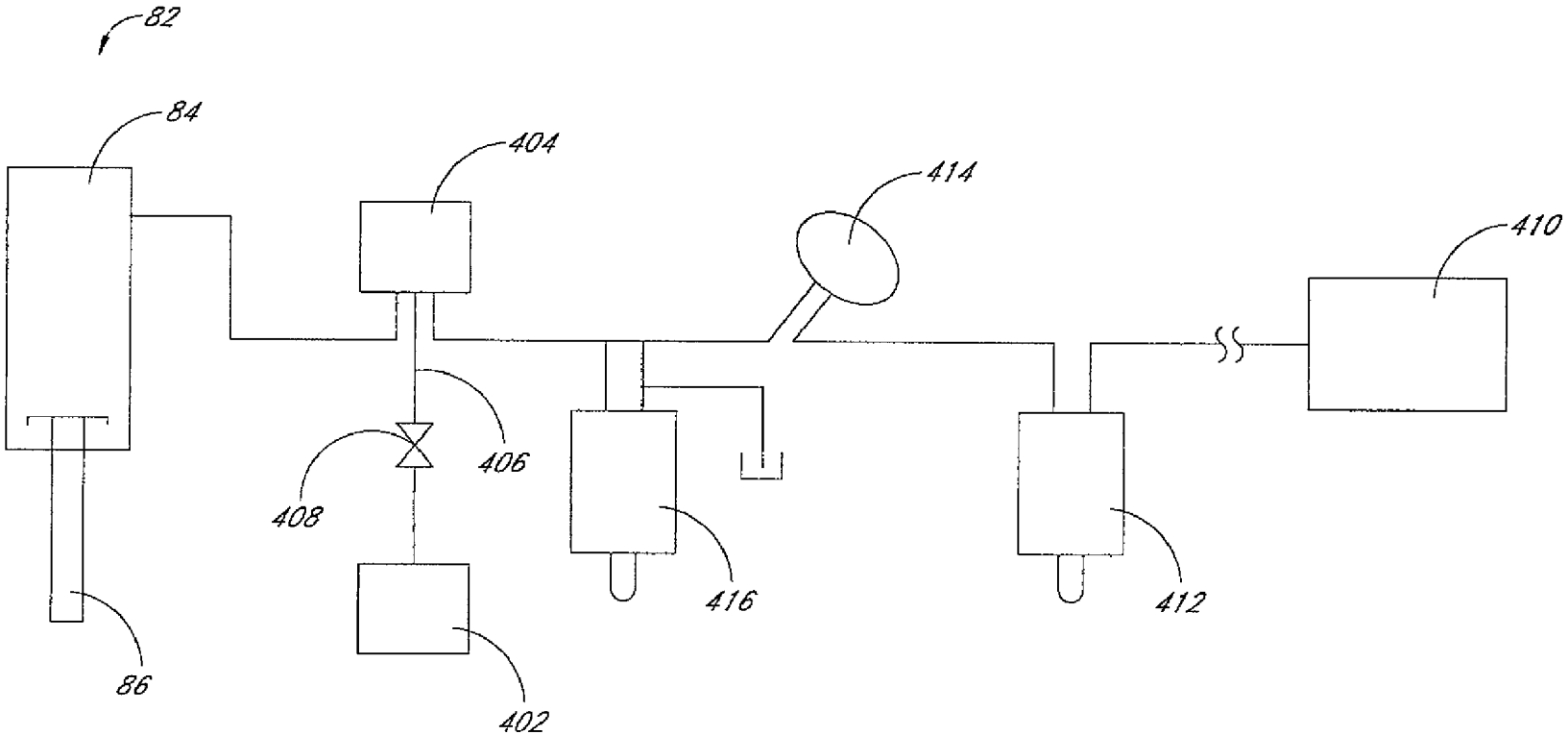
FIG. 13 is a schematic view of an additional embodiment of a resistance assembly that can be used with the exercise apparatus.

With reference next to FIG. 13, another embodiment of a pneumatic resistance assembly allows easy adjustment of the force characteristics of the device. As discussed above, in many embodiments, it is desired to have a generally constant resistance force over an exercise stroke. However, in some instances it is desirable to be able to quickly change to a force that increases over the stroke.

The resistance assembly 400 illustrated in FIG. 13 is similar to the embodiment of the resistance assembly 16 discussed above with reference to FIGS. 1-4, except that a second accumulator 402 is operatively connected to the first accumulator 404 via an air line 406, and each of the accumulators 402, 404 is about half the size of the accumulator 90 illustrated in FIG. 4. During a first mode of operation, the first and second accumulators 402, 404 collectively function the same as the accumulator 90 of FIG. 4. However, if a user desires to change the force characteristics, the user can simply actuate a valve 408 in order to isolate the second accumulator 402. The effective size of the air reservoir is lessened, and the force will increase over the exercise stroke.

As seen in FIG. 13, the resistance assembly 400 can also communicate with a source of air pressure 410 (e.g., a compressor) through an air inlet valve 412. The assembly preferably includes a gauge 414 (e.g., an air pressure gauge) to indicate the amount of resistance provided by the pneumatic actuator 82. A bleed off valve 416 also communicates with the cylinder 84 and at least the first accumulator 404 to reduce the resistance force provided by the pneumatic cylinder 82.

In additional embodiments, a pneumatic resistance system can comprise three or more accumulators of a plurality of sizes connected by one ore more air lines and can be selectively isolated from one another by user-actuated valves. Additionally, a valve can be interposed between the cylinder and the accumulator(s).

Although this invention has been disclosed in the context of certain preferred embodiments and examples, it will be understood by those skilled in the art that the present invention extends beyond the specifically disclosed embodiments to other alternative embodiments and/or uses of the invention and apparent modifications and equivalents thereof. For example, while the illustrated embodiments have employed the resistance unit in an upright position, the unit can be oriented differently (e.g., be laid horizontally or inclined) in many applications. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An exercise station comprising:

a housing including a pneumatic resistance assembly;

a pair of adjustable arms supported by the housing, the arms being disposed on opposite sides of the housing and extending outward from the housing;

a pair of user interfaces, each user interface being movable between a retracted position and an extended position;

a hinge assembly between each arm and the housing so as to allow at least vertical movement of the arm relative to the housing;

a locking mechanism, the locking mechanism allowing a user to releasably select a vertical position of the arm relative to the housing; and a cable.

2. The exercise station of claim 1, wherein the cable includes a first cable end and a second cable end, the second cable end being connect to one of the pair of user interfaces and the first cable end being connected to the other one of the pair of user interfaces.

3. The exercise station of claim 1 additionally comprising a block-and-tackle mechanism, the cable being attached to the block-and-tackle mechanism.

4. The exercise station of claim 1, wherein each arm has a tubular structure through which the cable passes.

5. The exercise station of claim 1, wherein the hinge assembly includes an inner pulley over which the cable runs.

6. The exercise station of claim 1, wherein each hinge assembly includes a bracket and a lug, the lug being selectively secured relative to the bracket.

7. The exercise station of claim 6, wherein the bracket is disposed on the housing and the lug is disposed on the arm.

8. The exercise station of claim 7, wherein the bracket includes at least two bracket plates, at least a portion of the lug being disposed between the at least two bracket plates.

9. The exercise station of claim 8, wherein the locking mechanism includes a plurality of holes and a dowel, at least a portion of the dowel engaging with one of the plurality of holes when the arm is in the selected vertical position with respect to the housing.

10. The exercise station of claim 9, wherein the plurality of holes are disposed in one of the at least two brackets.

11. The exercise station of claim 10 further comprising a knob, the knob controlling movement of the dowel.

12. The exercise station of claim 11 further comprising a support bracket, the support bracket being fixed to the lug and contacting the knob when the dowel is engaged with the selected one of the plurality of holes.

13. The exercise station of claim 11 further comprising a spring, the spring being disposed so as to bias the dowel to move into the selected one of the plurality of holes.

14. The exercise station of claim 11, wherein one of the plurality of holes is disposed in the bracket so as to allow the arm to be positioned to extend straight down when the dowel is engaged with the hole.

15. The exercise station of claim 11, wherein one of the plurality of holes is disposed in the bracket so as to allow the arm to be positioned to extend straight up when the dowel is engaged with the hole.

16. The exercise station of claim 11, wherein the plurality of holes are spaced in an arcuate pattern along an outer edge of the one of the at least two brackets.

17. The exercising station of claim 11, wherein the pneumatic resistance assembly includes a pneumatic actuator pivotally connected to the housing.

18. The exercise station of claim 17, wherein the pneumatic actuator is arranged to resist movement of the user interfaces toward the extended position.

19. An exercise station comprising:

a frame;

a pneumatic resistance secured to the frame;

a pulley system;

an adjustable arm extending outward from the frame;

a user interface being movable between a retracted position and an extended position;

a hinge between the arm and the frame; and a locking mechanism for releasably selecting a position of the arm relative to the frame.

20. An exercise apparatus comprising:

a frame;

a pneumatic actuator having a cylinder and a piston rod that extends from the cylinder along a stroke axis, the pneumatic actuator being disposed on the frame;

a pulley wheel rotatably connected to the piston rod;

an adjustable arm extending outward from the frame;

a movable user interface;

a hinge between the arm and the frame;

a locking mechanism for releasably selecting a position of the arm relative to the frame; and a cable.

21. The exercise apparatus of claim 20, wherein the piston rod is connected to the pulley wheel at a location offset from a center of the pulley wheel.

* * * * *

UNITED STATES PATENT AND TRADEMARK OFFICE

CERTIFICATE OF CORRECTION

PATENT NO. : 7,955,235 B2
APPLICATION NO. : 12/697103
DATED : June 7, 2011
INVENTOR(S) : Dennis L. Keiser It is certified that error appears in the above-identified patent and that said Letters Patent is hereby corrected as shown below:

At Column 6, Line 41, change “below” to --below.--.

At Column 14, Line 31, change “120°.” to --120°).--.

At Column 17, Line 61, change “ore” to --or--.

At Column 19, Line 18, in Claim 17, change “exercising” to --exercise--.

Signed and Sealed this
Sixth Day of March, 2012

David J. Kappos

David J. Kappos
*Director of the United States Patent and Trademark Office*